US005997135A

United States Patent [19]

Sugahara

[11] Patent Number: 5,997,135

[45] Date of Patent: Dec. 7, 1999

[54] TWO ACTUATOR SHEAR MODE TYPE INK JET PRINT HEAD WITH DIMENSIONAL RELATIONS

[75] Inventor: Hiroto Sugahara, Aichi-ken, Japan

[73] Assignee: Brother Kogyo Kabushiki Kaisha, Nagoya, Japan

[21] Appl. No.: 08/620,540

[22] Filed: Mar. 25, 1996

[30] Foreign Application Priority Data

| | | | |
|---|---|---|---|
| Mar. 27, 1995 | [JP] | Japan | 7-068026 |
| Mar. 28, 1995 | [JP] | Japan | 7-069562 |
| Mar. 28, 1995 | [JP] | Japan | 7-069563 |
| Apr. 5, 1995 | [JP] | Japan | 7-080119 |

[51] Int. Cl.[6] ..... B41J 2/045

[52] U.S. Cl. ..... 347/71; 347/69; 310/358

[58] Field of Search ..... 347/68–72; 310/328, 310/357, 358

[56] References Cited

U.S. PATENT DOCUMENTS

| | | | |
|---|---|---|---|
| 4,339,763 | 7/1982 | Kyser et al. | 347/71 |
| 4,879,568 | 11/1989 | Bartky et al. | 347/69 |
| 4,887,100 | 12/1989 | Michaelis et al. | 347/69 |
| 5,016,028 | 5/1991 | Temple | 347/69 |
| 5,159,349 | 10/1992 | Endo et al. | 347/3 X |
| 5,432,540 | 7/1995 | Hiraishi | 347/69 |
| 5,443,809 | 8/1995 | Pies et al. | 347/71 X |

FOREIGN PATENT DOCUMENTS

| | | | |
|---|---|---|---|
| 0 484 983 A2 | 5/1992 | European Pat. Off. . | |
| 484983A2 | 5/1992 | European Pat. Off. | 347/69 |
| 516284A2 | 12/1992 | European Pat. Off. | 347/69 |
| 0 528 648 A1 | 2/1993 | European Pat. Off. . | |
| 612622 | 8/1994 | European Pat. Off. | 347/69 |
| 53-12138 | 4/1978 | Japan . | |
| 2-61-59914 | 12/1986 | Japan . | |
| 63-247051 | 10/1988 | Japan | 347/69 |
| 63-252750 | 10/1988 | Japan | 347/69 |
| 2-150355 | 6/1990 | Japan | 347/69 |
| 4247944 | 9/1992 | Japan | 347/69 |
| 5-92561 | 4/1993 | Japan | 347/69 |

OTHER PUBLICATIONS

Patent Abstract of Japan, Maeno Fumio, "Liquid Droplet Jet Recording Apparatus", vol. 017, No. 53, Feb. 3, 1993.

*Primary Examiner*—Benjamin R. Fuller
*Assistant Examiner*—C. Dickens
*Attorney, Agent, or Firm*—Oliff & Berridge, PLC

[57] ABSTRACT

An ink jet print head is constructed from first and second actuator plates 102 and 103. Side walls 111 and 116 made from piezoelectric material are connected to each other. An ink chambers 112 filled with ink 181 is formed between two adjacent side walls each constructed from the side walls 111 and 116. The actuator plates 102 and 103 can be produced so that the length of the side walls 111 be different from the length of the side walls 116 so long as the ratio between those values does not exceed an upper limit of 3 or a lower limit of ⅓. The actuator plates 102 and 103 can be produced so that the width of the side walls 111 be different from the width of the side walls 116 so long as the ratio between those values does not exceed an upper limit of 2 or a lower limit of ½. The actuator plates 102 and 103 can be bonded to each other with the side walls 111 and 116 are shifted from each other so long as a ratio of the shift amount in regards to the width of the ink chambers does not exceed an upper limit of 0.5. A ratio of the ink chamber width to the side wall width is preferably in the range of ⅓ and 3.

46 Claims, 14 Drawing Sheets

TWO ACTUATOR SHEAR MODE TYPE INK JET PRINT HEAD WITH DIMENSIONAL RELATIONS

BACKGROUND OF THE INVENTION

1. Field of the Invention

The present invention relates to an ink jet print head, and more particularly to a shear mode type ink jet print head.

2. Description of the Related Art

Recently, drop-on-demand type ink jet print heads have been greatly developed. The drop-on-demand type print head ejects only the ink droplets to be used for printing.

Representative examples of the drop-or-demand print heads include a Kyser type disclosed in U.S. Pat. No.4,339,763 and a thermal jet type disclosed in U.S. Pat. No. 5,159,349. Each type of these print heads, however, involves problems. The Kyser type is difficult to be modified into a smaller size. In the thermal jet type, inks are required to have high thermal resistance properties.

A shear mode type of ink jet print head has therefore been proposed to solve both of these problems. This shear mode type print head is disclosed in U.S. Pat. Nos. 4,879,568, 4,887,100, and 5,016,028 and in Japanese Patent Application Publication Kokai No. 5-92561.

A shear mode type print head is conceivable as shown in FIGS. 1 to 6. Directional terms such as "upper" "lower,""front," and "rear" used in the following explanations refer to the ink jet print head when in the posture shown in FIG. 3.

As shown in FIG. 3, the ink jet print head 1 is constructed from an actuator plate 2, a cover plate 3, a nozzle plate 31, and a driving substrate 41. The actuator plate 2 is formed from a piezoelectric material, such as a lead zirconium titanate (PZT) ceramic material, having ferroelectric properties. As shown in FIG. 1, the actuator plate 2 is polarized in an upward direction indicated by an arrow 5, and has a plurality of grooves 15 and side walls 11 separating the grooves 15. The cover plate 3 is formed from a ceramic material or a resin material. The actuator plate 2 and the cover plate 3 are bonded together by an adhesive layer 4 made from, for example, an epoxy adhesive. This forms the grooves 15 into a plurality of ink chambers 12. Thus formed ink chambers 12 are arranged with a certain interval in a horizontal direction A normal to the polarizing direction 5.

As apparent from FIG. 3, each of the ink chambers 12 extends along another horizontal direction 3 which is perpendicular to both the directions A and 5. Thus, each ink chamber 12 has an elongated shape. Each ink chamber 12 has perpendicular cross-section as shown in FIG. 1. The side walls 11 extend over the entire length of the ink chambers 12. A pair of electrodes 13 for applying a driving voltage through the side walls 11 are formed on both side surfaces of the side walls 11 from the top of the side walls 11 near the adhesive layer 4 to the middle of the side walls 11. Ink 81 is introduced to the ink chambers 12 from an ink supply port 21 via a manifold 22.

With the above-described structure, the ink jet print head 1 operates as described below. As shown in FIG. 2, when an ink chamber 12*b*, for example, is selected to eject an ink droplet according to desired print data, a positive driving voltage is applied to the electrodes 13*c* and 13*d* while the electrodes 13*b* and 13*e* are grounded. As a result, an electric field is generated in a direction 14*a* through the side wall 11*a*, and an electric field is generated in a direction 14*b* in the side wall 11*b*. The directions 14*a* and 14*b* of the electric fields are substantially normal to the polarization direction 5. This makes the side walls 11*a* and 11*b* deform inwardly due to a piezoelectric thickness shear effect. The deformation of the side walls 11*a* and 11*b* reduces the volume in the ink chamber 12*b*, thereby increasing the pressure of the ink 81 in the ink chamber 12*b*. This generates a pressure wave, whereby a portion of the ink 81 is ejected in the form of an ink droplet from a nozzle 32 connected with the ink chamber 12*b*.

When the application of the driving voltage is stopped, the side walls 11*a* and 11*b* return to their original positions shown in FIG. 1. This reduces the pressure of the ink 81 in the ink chamber 12*b*, whereby an additional ink 81 is supplied into the ink chamber 12*b* from the ink supply port 21 via the manifold 22.

In the above description, the driving voltage is applied in a direction so that the volume of the ink chamber 12*b* decreases, whereby an ink droplet is ejected from the ink chamber 12*b*. Alternatively, the driving voltage may be applied in an opposite direction so that the volume of the ink chamber 12*b* first increases and so that ink is additionally supplied to the ink chamber 12*b*. When the application of the driving voltage is stopped, the side walls 11*a* and 11*b* return to their original positions shown in FIG. 1, thereby ejecting an ink droplet.

According to the above-described driving operations, two adjacent ink chambers cannot be driven to eject ink droplets simultaneously. Accordingly, the plurality of ink chambers 12 in the actuator 2 are divided into at least two groups, and the two groups are driven alternately. For example, the ink chambers 12 are divided into two groups so that ink chambers 12*b* and 12*d* are in one group while an ink chamber 12*c* is in the other group. The two groups are alternately driven.

Next, the method of manufacturing the print head 1 will be described with reference to FIG. 3.

An actuator plate 2 which has been polarized in the direction 5 is first subjected to a grinding process using a thin disk-shaped diamond blade. This grinding process produces the parallel grooves 15 each being sandwiched between two adjacent side walls 11. The grooves 15 extend from a front end surface 16 in a direction toward the rear end surface 17. The grooves 15 have the same depth over nearly the whole actuator plate 2. However, at a certain position near to the rear end surface 17, the grooves 15 are made to gradually become shallower as they approach the rear end surface 17, thus forming parallel shallow grooves 18 near the rear end surface 17.

Electrodes 13 and 19 are then formed on the inner surfaces of both the grooves 15 and the shallow grooves 18 through a process such as a vacuum vapor deposition and a sputtering. This process is designed so that the floor and the lower half of the inner side surface of the grooves 15 will not be formed with the electrodes 13. For example, when a vacuum vapor deposition process is employed, the actuator plate 2 is tilted at an angle in relation to a direction in which metal vapor travels from a deposition source. The tilt angle is selected so that the floor and the lower half of the inner side surfaces of the grooves 15 are in a shadow with respect to the metal vapor travelling direction.

Then, electrodes are removed from the top surface portions of the side walls 11 through a process such as lapping. As a result, electrodes on both sides of the side walls 11 are separated from each other. Electrodes 13 thus remain only on the upper half of the inner side surfaces on the grooves 15. Electrodes 19 remain on the entire inner side surfaces and bottom surface of the shallow grooves 18. Each electrode 19 is for electrically connecting electrodes 13 formed on both inner side surfaces of a corresponding groove 15.

Then, a cover plate 3 made from a ceramic material or a resin material is subjected to a grinding or cutting process so that the ink supply port 21 and the manifold 22 are formed in the cover plate 3.

Next, the side of the actuator plate 2 with the grooves 15 formed and the side of the cover plate 3 with the manifold 22 formed are bonded at the surfaces by an adhesive layer 4 made from an epoxy adhesive or the like. As a result, each of the grooves 15 forms an ink chamber 12 with a shape as shown in FIG. 1. Then, a nozzle plate 31 formed with nozzles 32 in positions corresponding to the position of each of the ink chambers 12 is bonded to the front end surface 16 of the actuator plate 2 and to a front end of the cover plate 3.

Then, the driving substrate 41 is bonded to the side opposite the grooved side of the actuator plate 2 by an epoxy adhesive or the like. The substrate 41 is provided with conductor layer patterns 42 in positions corresponding to the position of each shallow groove 18. The electrode 19 on the bottom surface of the shallow groove 18 and the corresponding conductor layer pattern 42 are then connected by a conductor wire 43 through a wire-bonding process. Because the diameter of the conductor wire 43 is extremely small with little mechanical strength, an epoxy resin or the like is used for forming (potting) a protective film (not shown) to prevent contact and breaking of adjacent conductor wires 43 and corrosion due to moisture or dust particles in the air. The protective film is thermally set.

The above-described ink jet print head 1 is provided with a driving control unit. The driving control unit is constructed from a LSI chip 51 as shown in FIG. 4. Each of the conductor layer patterns 42 formed on the driving substrate 41 are individually connected to the LSI chip 51. A clock line 52, a data line 53, a voltage line 54, and a ground line 55 are also connected to the LSI chip 51. The LSI chip 51 determines which nozzle 32 to eject the ink droplet from according to data appearing in the data line 53 based on clock pulses successively supplied from the clock line 52. The LSI chip 51 applies a voltage V of the voltage line 54 to the conductor layer pattern 42 electrically connected to the electrode 3 in the ink chamber 12 that is determined to eject the ink. Also, the LSI chip 51 applies the zero voltage of the ground line 55 to the conductor layer patterns 42 electrically connected to the electrodes 13 in the other ink chambers 12 which are not to eject the ink.

The above-described print head 1 is mounted in a printer as shown in FIG. 5.

The ink jet print head 1 is mounted on a carriage 62. An ink supply tube 63 is connected to the ink supply port 21 of the print head 1. The LSI chip 51 is incorporated in the carriage 62. A flexible cable 64 protrudes from the carriage 62 and is connected to a control center (not shown). The flexible cable 64 encloses the clock line 52, the data line 53, the voltage line 54, and the ground line 55. The carriage 62 is capable of moving along a slider 66 over an entire width of a recording paper 71 in both directions 65. When the carriage 62 is moving, the ink jet print head 1 ejects ink droplets from the nozzles 32. This deposits ink droplets on the recording paper 71 supported on a platen roller 72.

More specifically, the recording paper 71 is stationary when the ink droplets are ejected from the ink jet print head 1. However, each time the carriage 62 performs a predetermined moving operation, the recording paper 71 is moved a fixed amount in a direction 75 by a pair of paper feed rollers 73 and 74. As a result, the ink jet print head 1 is able to form a desired character or image over the entire surface of the recording paper 71.

In the above-described ink jet print head 1, as shown in FIG. 1, only the upper half of each side wall 11 is provided with the electrode 13. The top surface of each side wall 11 is fixedly bonded to the cover plate 3. With this structure, only the upper half of the side wall 11 is applied with the driving voltage, and is deformed due to the piezoelectric thickness shear effect. The lower half is deformed following the upper half. Accordingly, the side wall 11 is bent at its middle portion as shown in FIG. 2.

According to this deformation mechanism, the side wall 11 can not be deformed with a large amount. The side wall 11 is deformed with a relatively small amount in comparison with the amount of the electric energy applied to the electrode 13. It is impossible to obtain a large volume reduction of the ink chamber 12. For this reason, a high driving voltage has to be applied to the electrode 13 in order that the ink chamber 12 will eject in droplets that have a velocity and a volume sufficient to from high quality images on the paper 71 located opposite the ink jet print head 1. Accordingly, a relatively complicated and large sized driving circuit has to be connected to the voltage line 54. This will limit lowering the cost and miniaturizing the printer.

In order to solve this problem, the print head 1 can be modified into a two actuator plate type print head 101 as shown in FIG. 6.

This print head 101 is constructed from two actuator plates 102 and 103, which are substantially identical to the actuator 2. The actuator plate 102 is formed with grooves 115 and side walls 111 separating the grooves 115. The actuator plate 102 is polarized in a direction 105. The actuator plate 103 is formed with other grooves 117 and side walls 116 separating the grooves 117. The actuator plate 103 is polarized in a direction 106. The top surfaces of the actuator plates 102 and 103 are bonded to each other so that an end of each side wall 111 is connected to an end of a corresponding side wall 116. As a result, the polarizing directions 105 and 106 of the plates 102 and 103 become opposite with each other. Thus connected side walls 111 and 116 form a single side wall 118. The side wall 118 has substantially twice as high as the side wall 11 of the print head 1. Each groove 115 and a corresponding groove 117 communicates with each other to form a single ink chamber 112. The volume of the ink chamber 112 is substantially twice as large as that of the ink chamber 12 of the print head 1.

According to this two plate type print head 101, both sides of each side wall 111 are entirely covered with electrodes 114. Similarly, both sides of each side wall 116 are entirely covered with electrodes 113. The connected portion of the side walls 111 and 116 is freely movable. Accordingly, when driving voltages are a plied to the electrodes 113 and 114, the side walls 11 and 116 are entirely deformed due to the piezoelectric thickness shear effect so that they are bent at their connected portion. Accordingly, the side walls can be bent with an amount substantially twice as large as the amount, with which the side walls of FIG. 2 are bent, even when the same driving voltages are applied. The print head 101 can therefore generate the same ink pressure as does the ink jet print head 1 even when applied with only a half the driving voltage applied to the ink jet print head 1. The print head 101 can thus be driven with a driving voltage less than that applied to the ink jet print head 1. Accordingly, the print head 101 can be employed with a simpler driving circuit and therefore can be produced with a lower production cost. Additionally, the actuator plates 102 and 103 can be more reliably driven. The piezoelectric ceramic constituting the actuator plates have to be driven with a driving voltage lower than a predetermined amount of limit voltage. If a voltage higher than the limit voltage is applied to the actuator plates, the polarization formed in the piezoelectric ceramic will be broken down. According to this two actuator type print head, however, the actuator plates can be driven with a voltage sufficiently lower than the limit voltage. Accordingly, it is possible to drive the actuator plate with higher reliability.

It is, however, very difficult to actually produce two actuator plates 102 and 103 having exactly the same sizes. It is also very difficult to bond the two actuator plates 102 and 103 so that the side walls 111 and 116 be positioned accurately in correspondence with each other with no shifts.

SUMMARY OF THE INVENTION

The present inventor investigates how these inaccuracies in the structures of the actuator plates will affect the performances of the print head 101. The present inventor finds out that the velocity and volume of the ink droplets ejected from the print head 101 will possibly become insufficient depending on: the difference between the heights of the side walls 111 and 116; the difference between the widths of the aide walls 111 and 116; and the shift amount by which the side walls 111 are shifted from the side walls 116 in the direction A. The present inventor further finds out that the velocity and the volume of ink droplets are also affected by the relationship between the width of the ink chamber 112 and the width of the side walls 111 and 116.

An object of the present invention is therefore to provide an improved ink jet print head which can be easily produced but still which is capable of ejecting in droplets of velocity and volume sufficient to form good quality image even at a low driving voltage.

In order to solve this and other objects, the present invention provides an ink jet print head for ejecting ink droplets, the ink jet print head comprising: a first actuator plate formed with a plurality of first side walls, each first groove being defined between corresponding two adjacent first side walls, the first side walls including piezoelectric material polarized in a first direction, the first side walls being elongated in the first direction with a first height, an electrode being formed on each first side wall to develop an electric field through the first side wall in a direction is normal to the first direction; and a second actuator plate formed with a plurality of second side walls, each second groove being defined between corresponding two adjacent second side walls, the second side walls including piezoelectric material polarized in a second direction opposite to the first direction, the second side walls being elongated along the second direction with a second height, another electrode being formed on each second side wall to develop an electric field through the second side wall in a direction normal to the second direction, the second height being different from the first height, the difference between the first and second heights having a value which causes a ratio of the first height with regards to the second height not to exceed an upper limit of 3 and not to exceed a lower limit of ⅓, the second actuator plate being connected to the first actuator plate so that one end of each first side wall being connected to one end of a corresponding second side wall, each first groove being communicated with a corresponding second groove to form an ink chamber, the connected first and second side walls being deformed due to the electric field developed therethrough to thereby apply pressure in ink filled in the ink chamber.

The first side wall may have a first width, and the second side wall may have a second width. The second width may be different from the first width. The difference between the first and second widths may have a value which causes a ratio of the first width with regards to the second width not to exceed an upper limit of 2 and not to exceed a lower limit of ½.

Each first side wall may be connected to a corresponding second side wall so that the first side wall is shifted from the second side wall in a direction normal to the first and second directions. An amount of the shift may have a value which causes a ratio of the shift amount with regards to a width of the ink chamber not to exceed 0.5.

The ratio of a width of the ink chamber with regards to a width of one of the first and second side walls may be in a range of ½ and 2.

According to another aspect, the present invention provides an ink jet print head, for ejecting ink droplets, comprising: a first actuator plate formed with a plurality of first side walls arranged in a predetermined direction, the first side walls including a piezoelectric material polarized in a first direction normal to the predetermined direction, the first side walls being elongated in the first direction, first grooves being formed between two adjacent first side walls, an electrode being provided on each first side wall for developing an electric field through the first side wall in a direction normal to the first direction to thereby deform the first side wall, the first side wall having a first width; and a second actuator plate formed with a plurality of second side walls arranged in the predetermined direction, the second side walls including a piezoelectric material polarized in a second direction normal to the predetermined direction and opposite to the first direction, the second side walls being elongated in the second direction, second grooves being formed between two adjacent second side walls, an electrode being provided on each second side wall for developing an electric field through the second side wall in a direction normal to the second direction to thereby deform the first side wall, the second side wall having a second width, the second actuator plate being connected to the first actuator plate so that one end of each first side wall is connected to one end of a corresponding second side wall, each first groove being communicated with a corresponding second groove to form an ink chamber, the connected first and second side walls being deformed due to the electric field developed therethrough to thereby apply pressure in ink filled in the ink chamber, the first width of the first side walls and the second width of the second side walls being distributed so that a ratio of the first width in regards to the second width is located in a range of ½ and 2. The first side wall has a first length along the first direction, and the second side wall has a second length along the second direction. The first length may preferably be substantially equal to the second length.

According to still another aspect, the present invention provides an ink jet print head, for ejecting ink droplets, comprising: a first actuator plate formed with a plurality of first side walls arranged in a predetermined direction, the first side walls including a piezoelectric material polarized in a first direction normal to the predetermined direction, the first side walls being elongated in the first direction, first grooves being formed between two adjacent first side walls, an electrode being provided on each first side wall for developing an electric field through the first side wall in a direction normal to the first direction to thereby deform the first side wall, the first side wall having a first length along the first direction; and a second actuator plate formed with a plurality of second side walls arranged in the predetermined direction, the second side walls including a piezoelectric material polarized in a second direction normal to the predetermined direction and opposite to the first direction, the second side walls being elongated in the second direction, second grooves being formed between two adjacent second side walls, an electrode being provided on each second side wall for developing an electric field through the second side wall in a direction normal to the second direction to thereby deform the first side wall, the second side wall having a second length along the second direction, the second actuator plate being connected to the first actuator plate so that one end of each first side wall is connected to one end of a corresponding second side wall, each first groove being communicated with a corresponding second groove to form an ink chamber, the connected first and second side walls being deformed due to the electric fields developed therethrough to thereby apply pressure in ink filled in the ink chamber, the first length of the first side walls and the second length of the second side walls being distributed so that a ratio of the first length in regards to the second length is located in a range of ⅓ and 3. The first side wall has a first width and the second side wall has a second width. The first width may preferably be substantially equal to the second width.

According to a further aspect, the present invention provides an ink jet print head, for ejecting ink droplets, comprising: a first actuator plate formed with a plurality of first side walls arranged in a predetermined direction, the first side walls including a piezoelectric material polarized in a first direction normal to the predetermined direction, the first side walls being elongated in the first direction, first grooves being formed between two adjacent first side walls, an electrode being provided on each first side wall for developing an electric field through the first side wall in a direction normal to the first direction to thereby deform the first side wall; and a second actuator plate. formed with a plurality of second side walls arranged in the predetermined direction, the second side walls including a piezoelectric material polarized in a second direction normal to the predetermined direction and opposite to the first direction, the second side walls being elongated in the second direction, second grooves being formed between two adjacent second side walls, an electrode being provided on each second side wall for developing an electric field through the second side wall in a direction normal to the second direction to thereby deform the first side wall, the second actuator plate being connected to the first actuator plate so that one end of each first side wall is connected to one end of a corresponding second side wall, each first groove being communicated with a corresponding second groove to form an ink chamber, the ink chamber having a width in the predetermined direction, the connected first and second side walls being deformed due to the electric fields developed therethrough to thereby apply pressure in ink filled in the ink chamber, the ends of the first side walls being shifted from the ends of the second side walls in the predetermined direction, shift amounts being distributed so that a ratio of the shift amount in regards to a width of the ink chamber is equal to or lower than 0.5. The first side well has a first width in the predetermined direction and the second side wall has a second width in the predetermined direction. The first width may preferably be substantially equal to the second width. The first side wall has a first length along the first direction and the second side wall has a second length along the second direction. The first length may preferably be substantially equal to the second length.

According to another aspect, the present invention provides an ink jet print head, for ejecting into droplets, comprising: a first actuator plate formed with a plurality of first side walls arranged in a predetermined direction, the first side walls including a piezoelectric material polarized in a first direction normal to the predetermined direction, the first side walls being elongated in the first direction, first grooves being formed between two adjacent first side walls, an electrode being provided on each first side wall for developing an electric field through the first side wall in a direction normal to the first direction to thereby deform the first side wall, the first side wall having a first width; and a second actuator plate formed with a plurality of second side walls arranged in the predetermined direction, the second side walls including a piezoelectric material polarized in a second direction normal to the predetermined direction and opposite to the first direction, the second side walls being elongated in the second direction, second grooves being formed between two adjacent second side walls, an electrode being provided on each second side wall for developing an electric field through the second side wall in a direction normal to the second direction to thereby deform the first side wall, the second side wall having a second width, the second actuator plate being connected to the first actuator plate so that one end of each first side wall is connected to one end of a corresponding second side wall, each first groove being communicated with a corresponding second groove to form an ink chamber, the ink chamber having a width in the predetermined direction, the connected first and second side walls being deformed due to the electric field developed therethrough to thereby apply pressure in ink filled in the ink chamber, the first width of the first side walls, the second width of the second side walls, and the width of the ink chambers being distributed so that a ratio of the width of the ink chambers in regards to one of the first width and the second width is in a range of ⅓ and 3. The first width may preferably be substantially equal to the second width. The first side wall has a first length in the first direction and the second side wall has a second length in the second direction. The first length may preferably be substantially equal to the second length.

BRIEF DESCRIPTION OF THE DRAWINGS

The above and other objects, features and advantages is of the invention will become more apparent from reading the following description of the preferred embodiment taken in connection with the accompanying drawings in which.

DETAILED DESCRIPTION OF THE PREFERRED EMBODIMENT

Figure 1:
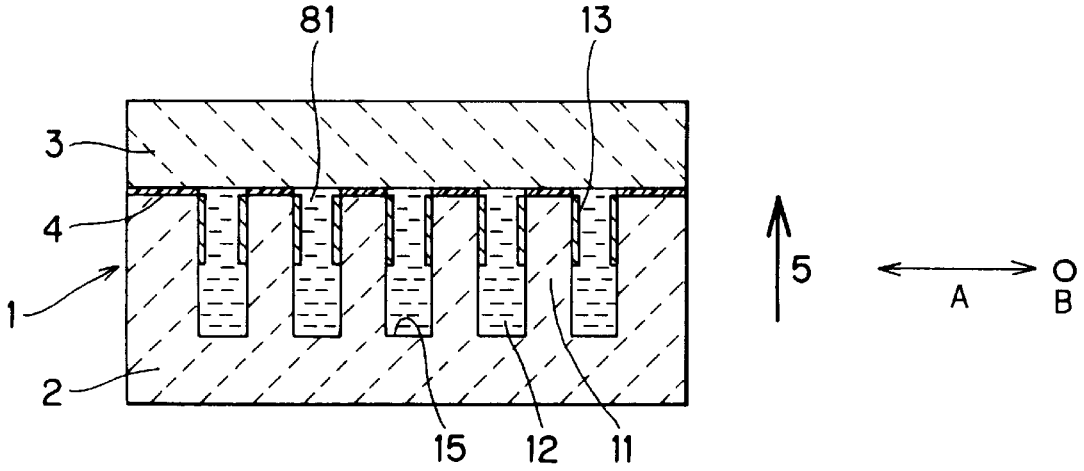
FIG. 1 (PRIOR ART)
FIG. 1 is a cross-sectional view of a conceivable ink jet print head taken along a line I–I' in FIG. 3.
Figure 2:
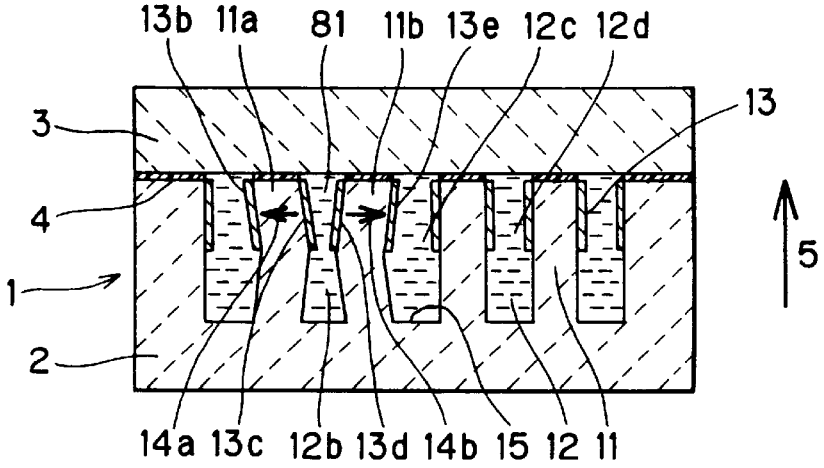
FIG. 2 (PRIOR ART)
FIG. 2 illustrates the operation of the ink jet print head of FIG. 1.

An ink jet print head according to a preferred embodiment of the present invention will be described while referring to the accompanying drawings wherein like parts and components are designated by the same reference numerals as those shown in FIGS. 1 through 6 to avoid duplicating description.

Figure 7A:
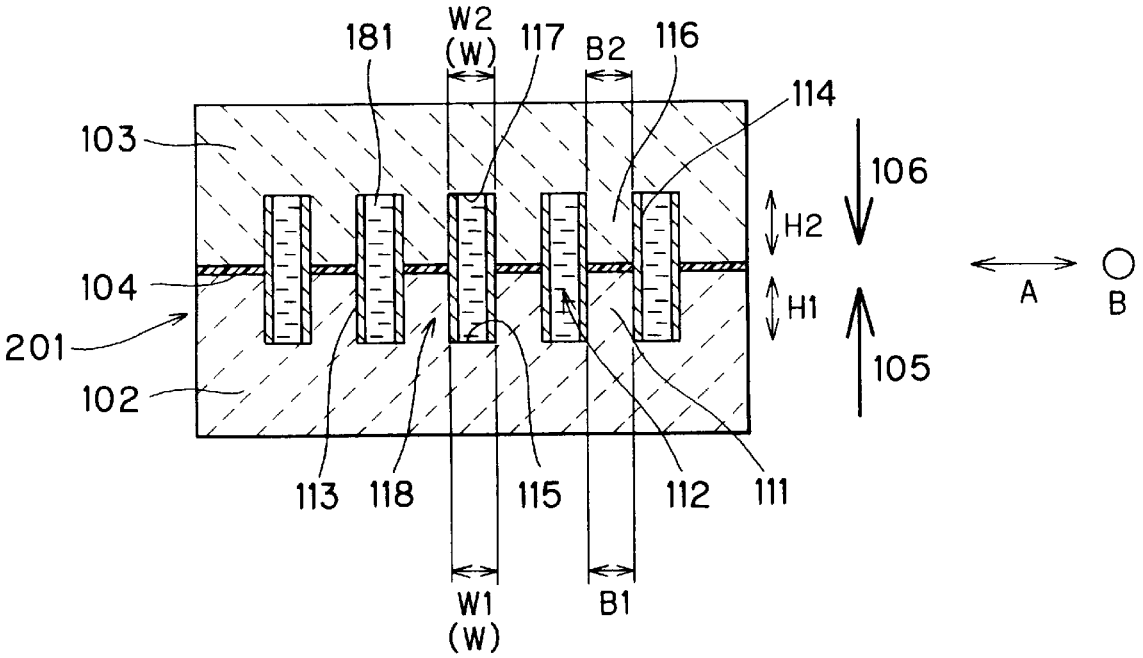
FIG. 7(A) is a cross-sectional view of an ink jet print head, taken along a line VIIA–VIIA'in FIG. 7(B), according to an embodiment of the present invention.

As shown in FIG. 7(A), according to the embodiment of the present invention, an ink jet print head 301 has an actuator portion 201 constructed from two actuator plates 102 and 103.

The actuator plate 102 is formed from a piezoelectric material having ferroelectric properties. The actuator plate 102 is polarized in an upward direction indicated by an arrow 105, and has a plurality of grooves 115 and side walls 111 separating the grooves 115. The grooves 115 are therefore arranged with a certain interval in a horizontal direction A which is perpendicular to the direction 105.

Similarly, the actuator plate 103 is formed from the piezoelectric material having the ferroelectric properties. The actuator plate 103 is polarized in a downward direction indicates by an arrow 106, and has a plurality of grooves 117 and side walls 116 separating the grooves 117. Thus, the actuator plates 102 and 103 are polarized in opposite directions. The grooves 117 are arranged with the certain interval in the horizontal direction A.

Figure 3:
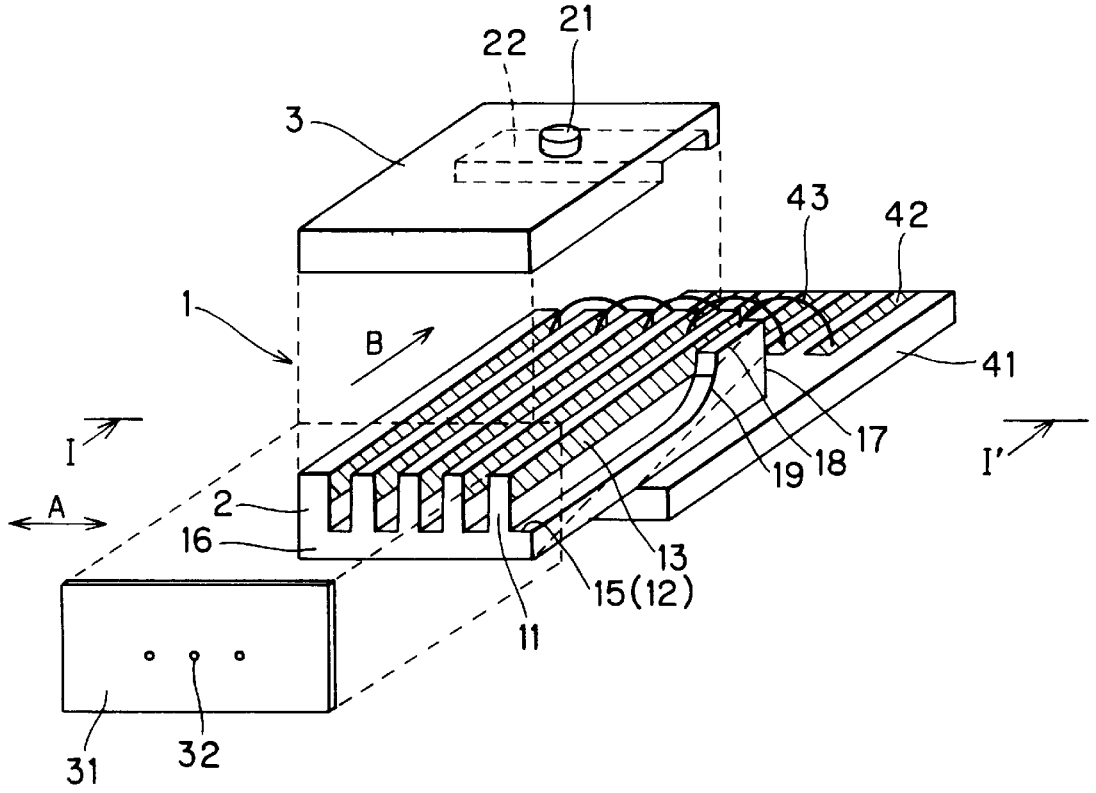
FIG. 3 (PRIOR ART)
FIG. 3 is a perspective view illustrating how the ink jet print head is assembled.
Figure 4:
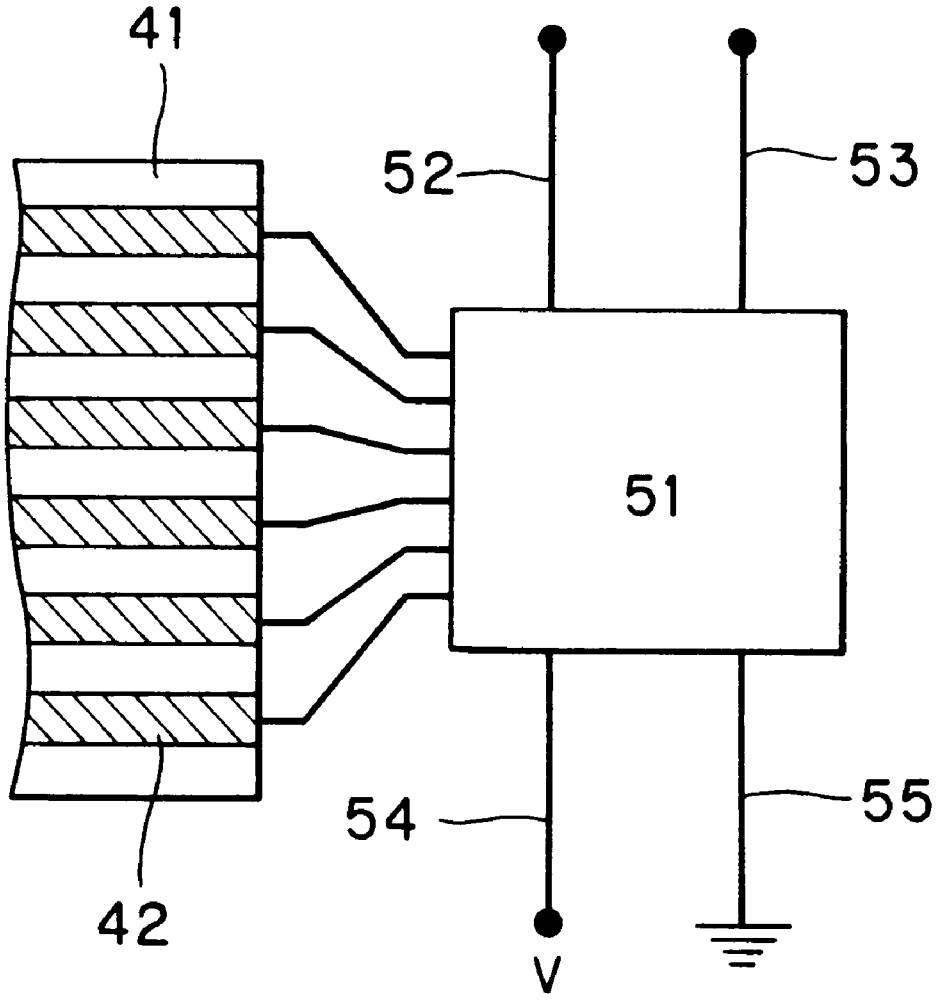
FIG. 4 (PRIOR ART)
FIG. 4 is a block diagram of a control unit for the ink jet print head.

Each of the actuator plates 102 and 103 has substantially the same configuration with the actuator plate 2 shown in FIG. 3. That is, in the actuator plate 102, the grooves 115 have an elongated shape with a rectangular cross-section. The grooves 115 extend along another horizontal direction B which is perpendicular to both the directions A and 105. The side wails 111 extend over the entire length of the grooves 115. It is noted that a pair of electrodes 113 are formed entirely on both side surfaces of the side walls 111. Similarly, in the actuator plate 103, the grooves 117 have an elongated shape with a rectangular cross-section. The grooves 117 extend along the horizontal direction B. The side walls 116 extend over the entire length of the grooves 117. A pair of electrodes 114 are formed entirely on both side surfaces of the side walls 116.

The actuator plates 102 and 103 can be produced through the same procedure for producing the actuator plate 2 of FIG. 3 except that the entire side surfaces of the side walls 111 and 116 are formed with the electrodes 113 and 114. The electrodes 113 and 114 can be produced not only through the vacuum vapor deposition and the sputtering but also through a metal plating method. Though the actuator plate 2 of FIG. 3 is formed with shallow grooves 18 at the rear ends of the grooves 15, the grooves 115 and 117 of the present embodiment may not be formed with such shallow grooves. The grooves 115 and 117 may be formed to have the same depth all over the whole actuator plates 102 and 103. However, those shallow grooves 18 may be formed to the grooves 115 and 117.

Then, the top surface of the side wall 111 is bonded by an adhesive layer 104 to the top surface of the side wall 116. Each side wall 111 and a corresponding side wall 116 is therefore joined into a single side wall 118. Each groove 115 is communicated with a corresponding groove 117 to form a single ink chamber 112. Similarly to the actuator plate 2 of FIG. 3, the thus formed ink chambers 112 have an elongated shape with a rectangular cross-section. The ink chambers 112 extend along the direction B. The side walls 118 extend over the entire length of the ink chambers 112. The electrodes 113 and 114 provided on the both side surfaces of the side walls 118 apply a driving voltage through the side walls 118.

The ink jet print head 301 of the present embodiment can be assembled as shown in FIG. 7(E) from the actuator portion 201 having the above-described structure. That is, a nozzle plate 31 is bonded to the front end surface 16 of the actuator portion 201. Electrode patterns 150 are formed on a rear end surface 17 of the actuator portion 201. The electrode patterns 150 are connected with the rear tip ends of the electrodes 113 and 114 which are located at the rear ends of the ink channels 112.

According to the present embodiment, a flexible electrode-printed plate 141 is attached to an upper surface of the actuator portion 201 through a soldering method. The flexible plate 141 is formed with conductor layer patterns 142 similarly to the driving substrate 41 of FIG. 3. Each conductor layer pattern 142 is electrically connected to a corresponding electrode pattern 150. One end of each conductor layer pattern 142 is electrically connected to the LSI chip 51 in the control unit of FIG. 4.

Although not shown in the drawings, the electrode patterns 150 may be formed also on the front end surface 16 of the actuator portion 201. The electrode patterns 150 connect with the front tip ends of the electrodes 113 and 114 located at the front ends of the ink chambers 112. The electrode patterns 150 may be connected with the conductor patterns 142.

An ink seal plate 121 is bonded to the rear end 17 of the actuator portion 201. The ink seal plate 121 is formed with a plurality of through-holes 122, through which the ink channels 112 are communicated with a manifold (not shown). An ink supply port (not shown) is connected to the manifold. Ink 181 is therefore introduced to the ink chambers 112 from the ink supply port via the manifold. Thus assembled ink jet print head 301 is mounted to the ink jet printer shown in FIG. 5 in the same manner as the ink jet print head 1.

The ink jet print head 301 having the above-described structure operates as described below.

Figure 7B:
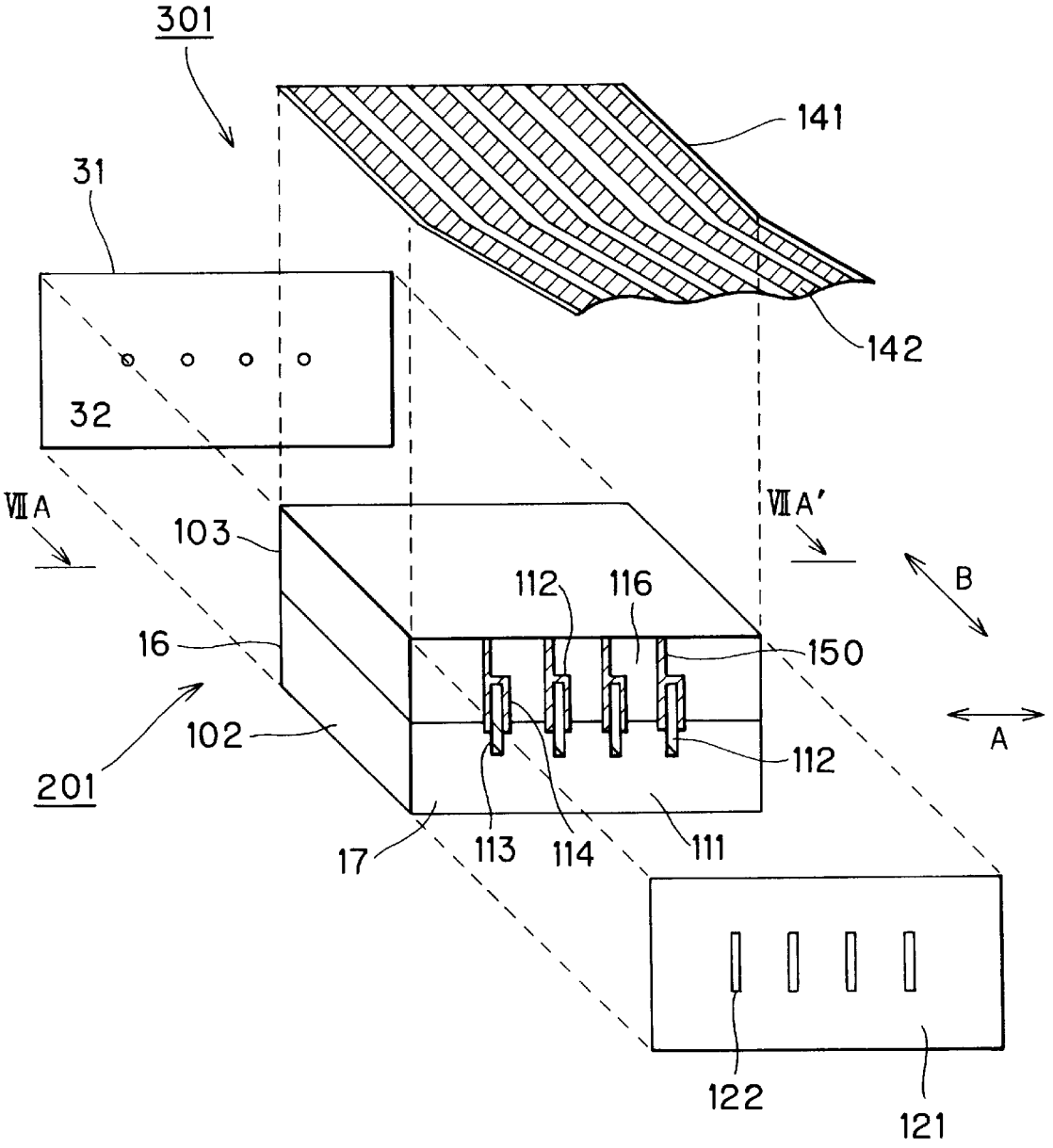
FIG. 7(B) is a perspective view illustrating how to assemble the ink jet print head according to the embodiment of the present invention.
Figure 8:
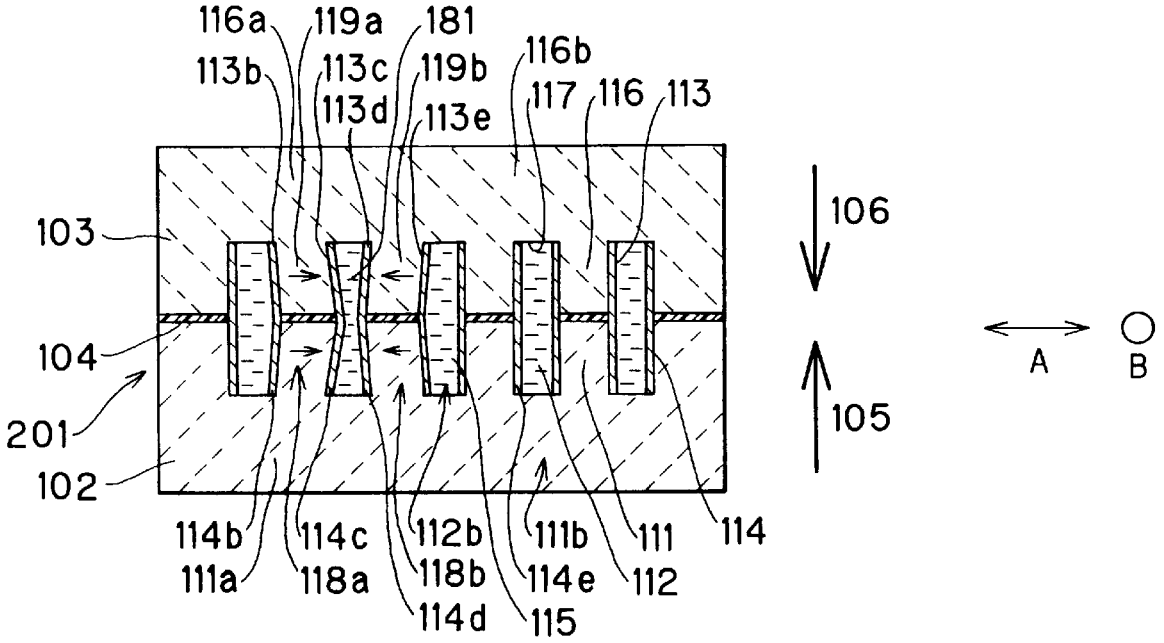
FIG. 8 illustrates the operation of the ink jet print head of FIG. 7.

As shown in FIG. 8, when an ink chamber 112*b* , for example, is selected to eject an ink droplet according to desired print data, a negative driving voltage is applied to the electrodes 113*c*, 114*c*, 113*d* and 114*d* while the electrodes 113*b*, 114*b*, 113*e*, and 114*e* are grounded. Or otherwise, a positive driving voltage is applied to the electrodes 113*b*, 114*b*, 113*e*, and 114*e* while the electrodes 113*c*, 114*c*, 113*d* and 114*d* are grounded. As a result, an electric field is generated in a direction 119*a* through the side wall 118*a*. That is, the electric field 119*a* is generated in both the side walls 111*a* and 116*a* that constitute the side wall 118*a*. Similarly, an electric field is generated in a direction 119*b* in the side wall 118*b*. That is, the electric field 119*b* is generated in both the side walls 111*b* and 116*b* that constitute the side wall 118*b*. The directions 119*a* and 119*b* of the electric fields are substantially normal to the polarization directions 105 and 106. This makes the side walls 118*a* and 118*b* deform inwardly due to the piezoelectric thickness shear effect. In more concrete terms, both the side walls 111*a* and 116*a* are deformed so that the side wall 118*a* is bent at its middle portion, i.e., at the connecting area where the side walls 111*a* and 116*a* are connected. Similarly, both the side walls 111*b* and 116*b* are deformed so that the side wall 118*b* is bent at its middle portion, i.e., at the connecting area where the side walls 111*b* and 116*b* are connected. The deformation of the side walls 118*a* and 118*b* reduces the volume in the ink chamber 112*b*, thereby increasing the pressure of the ink 81 in the ink chamber 112*b*. This generates a pressure wave, whereby a portion of the ink 81 is ejected in the form of an ink droplet from a nozzle 32 connected with the ink chamber 112*b*. When the application of the driving voltage is stopped, the side walls 118*a* and 118*b* return to their original positions shown in FIG. 7 (A). This reduces the pressure of the ink 81 in the ink. chamber 112*b*, whereby an additional ink 81 is supplied into the ink chamber 112*b* from the ink supply port via the manifold and the ink seal plate 121.

In the above description, the driving voltage is applied in a direction so that the volume of the ink chamber 112*b* decreases, whereby an ink droplet is ejected from the ink chamber 112*b*. Alternatively, the driving voltage may be applied in an opposite direction so that the volume of the ink chamber 112*b* first increases and so that ink is additionally supplied to the ink chamber 112*b*. Than, the application of the driving voltage is stopped, whereby the side walls 118*a* and 118*b* return to their original positions shown in FIG. 7(A), thereby ejecting an ink droplet.

According to this two actuator type print head of the present invention, both the side walls 111 and 16 are entirely deformed to bend their constituting side well 118. Accordingly, the side wall 118 can be bent even applied with a small driving voltage.

As shown in FIG. 7(A), the side walls 111 and 116 have the widths B1 and B2 along the direction A. The side walls 111 and 116 have the heights H1 and H2 along the directions 105 and 106. The grooves 115 and 117 have the widths W1 and W2 along the direction A so that the ink chambers 112 have the width W (=W1, W2).

According to the present embodiment, the width B1 of the side walls 111 may not be identical to the width B2 of the side walls 116. That is, the ratio of the width B1 to the width B2 is not necessarily 1. The width B1 can be differentiated from the width B2 so long as the B1/B2 does not exceed an upper limit of 2 or a lower limit of ½.

Similarly, the height H1 of the side walls 111 may not be identical to the height H2 of the side walls 116. That is, the ratio of the height H1 to the height H2 is not necessarily 1. The length H1 can be differentiated from the length H2 so long as the ratio H1/H2 does not exceed an upper limit of 3 or a lower limit of ⅓.

When bonding the top surfaces of the side walls 111 to the top surfaces of the side walls 116, they may be shifted from each other in the direction A so long as the ratio of the shift amount δ, by which the side walls 111 are shifted from the side walls 116 in the direction A, in regards to the width W of the ink chamber 112 (W=W1, W2) does not exceed 0.5.

It is further noted that a ratio W1/B1 of the width of the groove 115 to the width B1 of the side wall 111 is preferably in a range of ⅓ and 3. More preferably, the ratio W1/B1 is in a range of ½ and 2. Similarly, a ratio W2/B2 of the width W2 of the groove 117 to the width B2 of the side wall 116 is preferably in a range of ⅓ and 3. More preferably, the ratio W2/B2 is in a range of ½ and 2.

[First Experiment]

Figure 9:
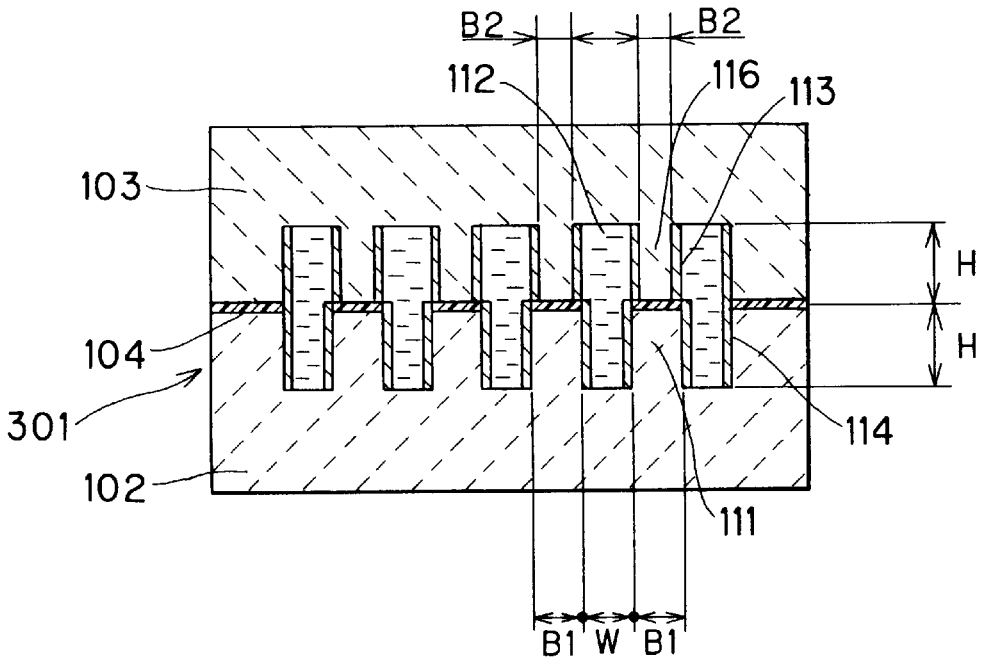
FIG. 9 illustrates a cross-section of an example of print head samples, used in a first experiment, where a first actuator has a side wall width B1 and a second actuator plate has a side wall width B2.

The present inventor produced several print heads 301 shown in FIG. 9 where the widths B1 and B2 of the side walls 111 and 116 had various values, and examined the printing performances obtained by those print heads 301.

More specifically, several print head samples 301 were produced with different B1/B2 ratios. In each sample 301, the actuator plates 102 and 103 were produced from barium titanate piezoelectric ceramic material. Nickel layers with a thickness of about 1 μm were provided onto the side walls 111 and 116 through electroless plating processes to form the electrode 113 and 114. A thermosetting epoxy adhesive was used as the adhesive layer 104 to bond the actuator elates 102 and 103 with each other. A water-based dye ink was used as an ink.

In the thus prepared several samples, the width B1 of the side wall 111 was varied over a range of 40 μm to 200 μm. The width B2 of the side wall 116 was also varied over a range of 40 μm to 200 μm. The heights H1 and H2 of the side walls 111 and 116 were both fixed to 200 μm. The width W of the ink chamber 112 (i.e., the widths W1 and W2 of the grooves 115 and 117) was fixed to 70 μm.

In each of the thus prepared sample heads, a fixed driving voltage (24 volts) was applied to the electrodes 113 and 114 for one ink chamber 112 so that an ink droplet be ejected from the corresponding nozzle. Then, the velocity and volume of the ink droplet were measured.

The velocity v of the ink droplets was measured by the following method.

After a time Δt elapsed from the moment that the driving voltage was applied to the electrodes 113 and 114, a strobe was flashed, illuminating the flying ink droplet. This provided a still image of the ink droplet. Based on the thus obtained still image, the present inventor measured the distance ΔX between the nozzle and the position of the ink droplet. Then, the present inventor calculated the velocity v of the ink droplet by Δx/Δt.

The volume L of the ink droplets was measured by the following method.

First, ink droplets jetted from the nozzle were collected on an electronic balance during a certain time period. Then, the weight Δw of a single droplet was calculated by measuring the mass of the collected ink droplets. By measuring the density ρ of the ink, the volume L of the single ink droplet was calculated by Δw/ρ.

Figure 10:
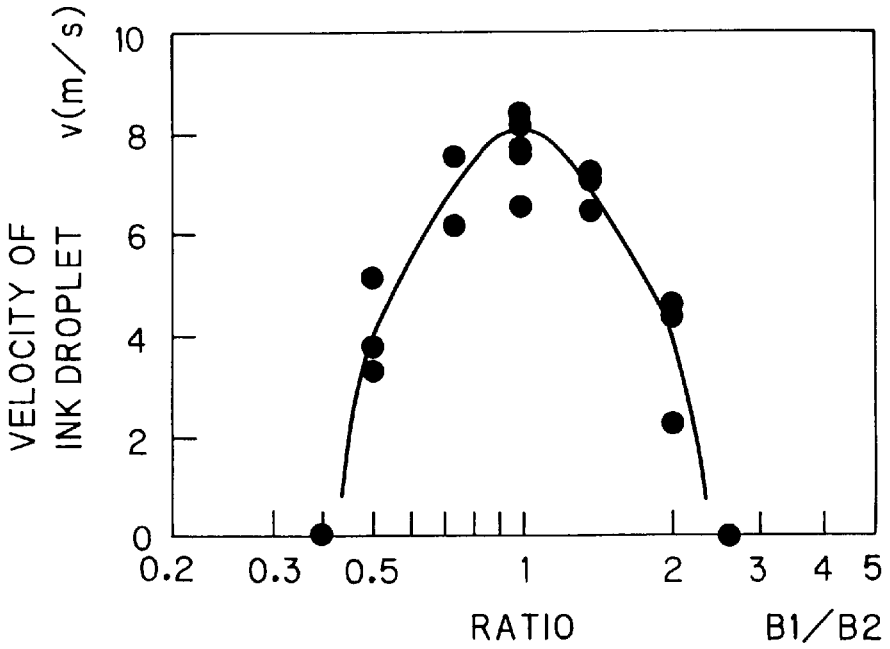
FIG. 10 is a graph illustrating the relationship between the ink droplet velocity v and a B1/E2 ratio.

FIG. 10 shores the results of the velocity measurements. It is apparent that the velocity v of the ink droplets became maximum and had about the value of 8 m/s when the B1/B2 ratio was approximately 1. When the B1/B2 ratio was in a range between ⅔ and 3/2, the velocity v was at least 75% of the maximum value, i.e., about 6 m/s. When the B1/B2 ratio was in another range of ½ and 2, the velocity v was at least 50% of the maximum value, i.e., about 4 m/s. When the B1/B2 ratio was out of the range of ½ and 2, the velocity v decreased rapidly.

The volume L of the ink droplet changed nearly proportional to the velocity v. That is, the volume became the maximum value of 80 pl when the B1/B2 ratio was approximately 1. When the B1/B2 ratio was in the range of ⅔ and 3/2, the volume L was at least 75% of the maximum value, i.e., 60 pl. When the B1/B2 ratio was in the range of ½ and 2, the volume L was at least 50% of the maximum value, i.e., 40 pl. When the B1/B2 ratio was out of the range of ½ and 2, the volume L decreased rapidly.

Figure 5:
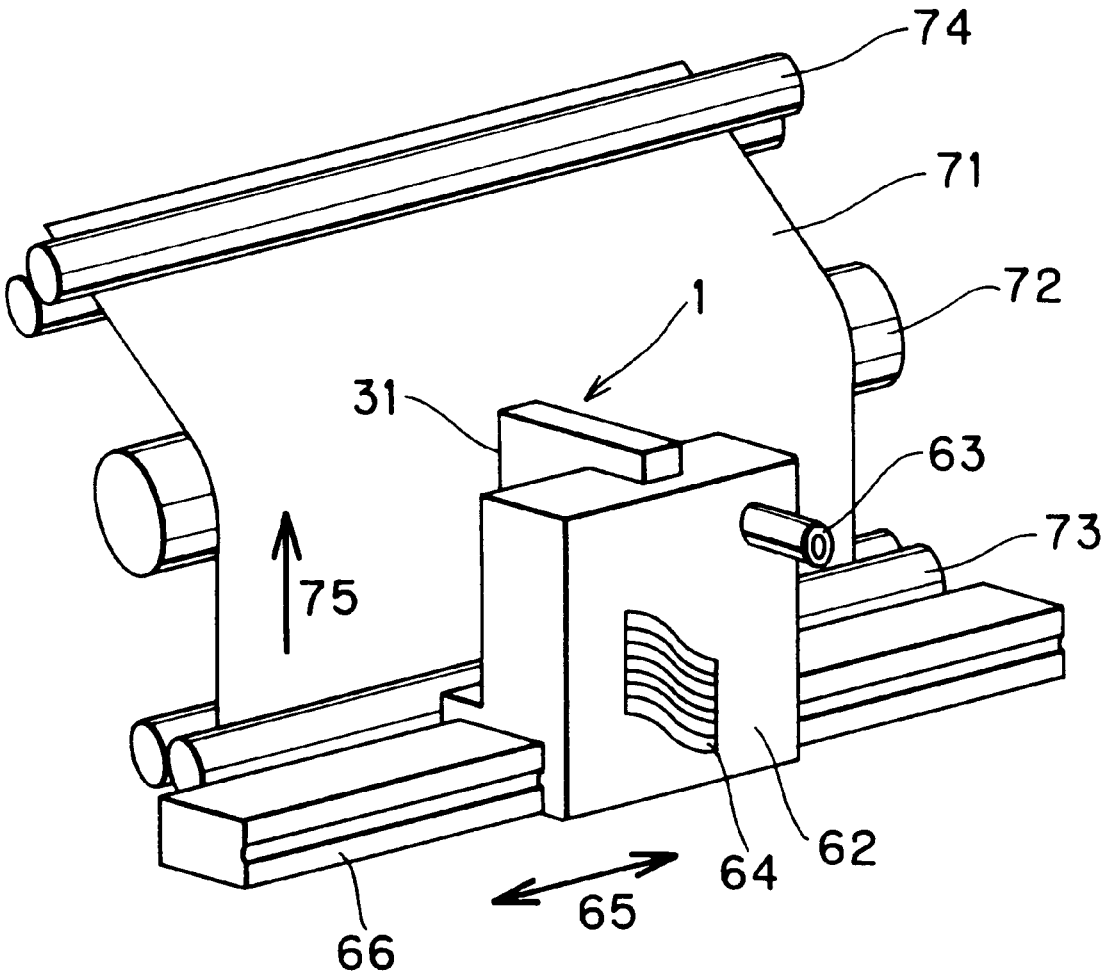
FIG. 5 (PRIOR ART)
FIG. 5 is a perspective view of a printer employed with the ink jet print head.
Figure 6:
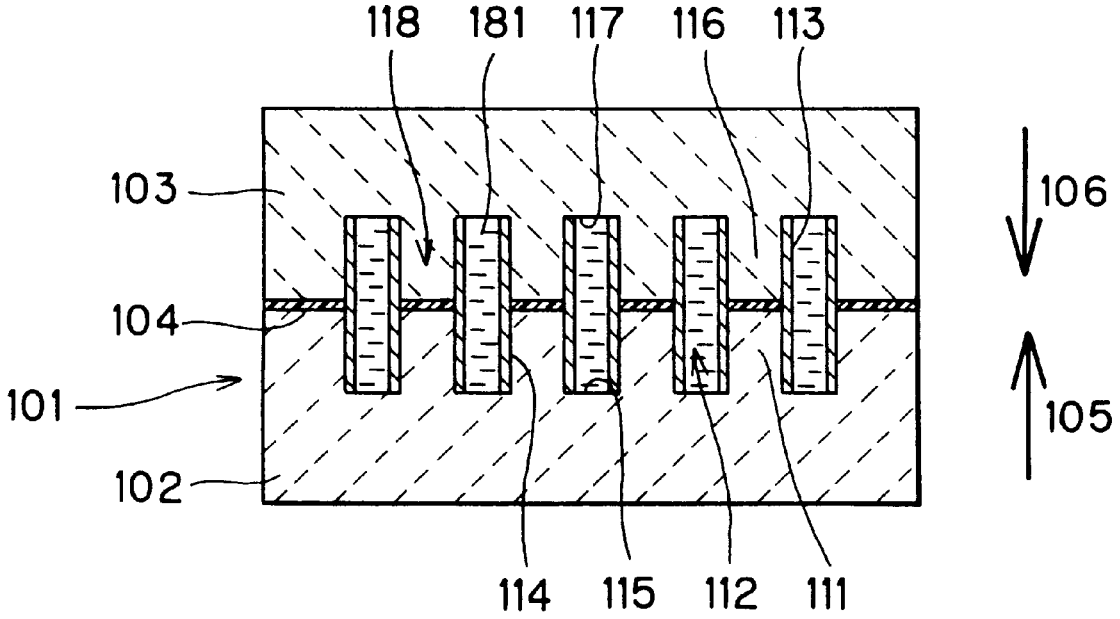
FIG. 6 (PRIOR ART)
FIG. 6 is a cross-sectional view of another conceivable ink jet print head.

When the ink droplets had the maximum velocity v (i.e., about 8m/s) and the maximum volume L (i.e., about 80 p1), the ink droplets provided a sufficiently high print density on the print surface 71, which was located opposite the print head 301 as shown in FIG. 5. Still, the ink droplets did not pass through the paper and did not reach a reverse side of the paper. Ink droplets that were ejected from adjacent nozzles were deposited on the print surface without forming any spaces therebetween. The ink droplets thus succeeded in providing an optimum image quality.

Even when the velocity v and the volume L were decreased, while they had the values of 75% or more of the maximum values, the ink droplets still succeeded in providing the optimum image quality.

When the velocity v and the volume L reached 75% of the maximum value, however, spaces appeared between the individual ink droplets deposited on the print surface. In other words, the print density started lowering. However, the obtained image quality was still acceptable until the velocity v and the volume L reached 50% of the maximum value.

When the velocity v and the volume L reached 50% of the maximum value, those spaces between the ink droplets became considerably remarkable, and therefore the print density became considerably low. Additionally, the ink droplets failed to linearly fly or travel from the nozzles toward the print surface. Positions, at which the ink droplets reached on the print sheet, widely distributed. When printing a line, an edge portion of the printed line will be blurred. The obtained print quality was not acceptable.

It is therefore apparent that the ink jet print head 301 of the present embodiment should be configured so that the B1/B2 ratio does not exceed the upper limit of 2 or the lower limit of ½. More preferably, the print head 301 should be configured so that the B1/B2 ratio does not exceed the upper limit of 3/2 or the lower limit of ⅔.

It is noted that FIG. 10 shows the results when the driving voltage was 24 volts. Setting the driving voltage at another value changed the value of the velocity v. However, when the B1/B2 ratio was varied, the location of the maximum value for the velocity v and the graph shape became identical to FIG. 10. Further, the volume L of the ink droplets at other voltage values also showed the same tendency as 24 volts. The obtained print quality also presented the same tendency as 24 volts.

It is also noted that FIG. 10 shows the results when the heights H1 and H2 of the side walls 111 and 116 were both fixed to 200 μm. However, even when the heights H1 and H2 were varied in a range from 100 μm to 400 μm, as the B1/B2 ratio was varied, the location of the maximum value for the velocity v and the graph shape became identical to FIG. 10. Further, the volume L of the ink droplets also showed the same tendency as a height of 200 μm. The obtained print quality also presented the same tendency as the height of 200 μm.

As apparent from the above results, the ink jet print head 301 of the present embodiment can be configured so that the width B1 is different from the width B2 so long as the B1/B2 ratio does not exceed the upper limit of 2 or the lower limit of ½. More preferably, the print head 301 can be configured so that the width B1 be different from the width B2 so long as the B1/B2 ratio does not exceed the upper limit of 3/2 or the lower limit of ⅔. If the B1/B2 ratio exceeds ½ or 2, then the velocity and volume of the ink droplets will become insufficient to form characters and images on the paper surface 71 which is located opposite the ink jet print head 301. Therefore, the driving circuit has to be increased in complexity and size in order to produce a higher driving voltage. Contrarily, so long as the B1/B2 ratio does not exceed ½ or 2, the print head can eject ink droplets with sufficient velocity and volume to form characters and images even at a low driving voltage. More specifically, as apparent from the examination results, an ink droplet velocity of about 3 to 8 m/s and volume of about 30 to 80 pl can be obtained at the low driving voltage of 18 to 28 volts. This allows simplification and miniaturization of the driving circuit, enabling the achieving of a lower cost and smaller size for the whole ink jet print head.

Additionally, it becomes unnecessary to produce the actuator plates 102 and 103 so that the widths B1 and B2 are completely equal to each other so long as the difference between the widths B1 and B2 does not cause the B1/B2 ratio to exceed the upper limit of 2 or the lower limit of ½. Accordingly, the side walls 111 and 116 can be easily produced through the grinding operation.

[Second Experiment]

Figure 11:
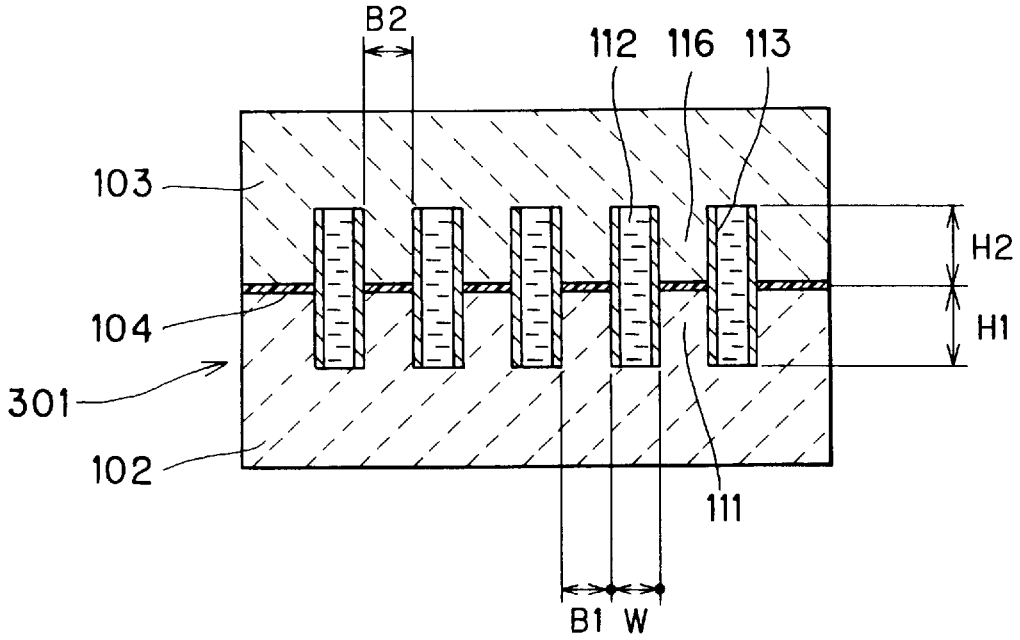
FIG. 11 illustrates a cross-section of an example of print head samples, used in a second experiment, where a first actuator has a side wall height H1 and a second actuator plate has a side wall height H2.

The present inventor produced several print heads 301 shown in FIG. 11 where the heights H1 and H2 of the side walls 111 and 116 had various values, and examined the printing performances obtained by those print heads 301. That is, the present inventor produced several print head samples 301 with different H1/H2 ratios. Those print head samples were produced in the same manner as in the first experiment.

In the thus prepared several samples, the heights H1 and H2 of the side walls 111 and 116 were varied over a range of 40 μm to 400 μm. The widths B1 and B2 of the side walls 111 and 116 were fixed to 70 μm. The width W of the ink chamber 112 (i.e., the widths W1 and W2 of the grooves 115 and 117) was fixed to 70 μm.

In each of the thus prepared sample heads, a fixed driving voltage (24 volts) was applied to the electrodes 113 and 114 for one ink chamber 112 so that an ink droplet be ejected from the corresponding nozzle. Then, the velocity and volume of the ink droplet were measured in the same manner as in the first experiment.

Figure 12:
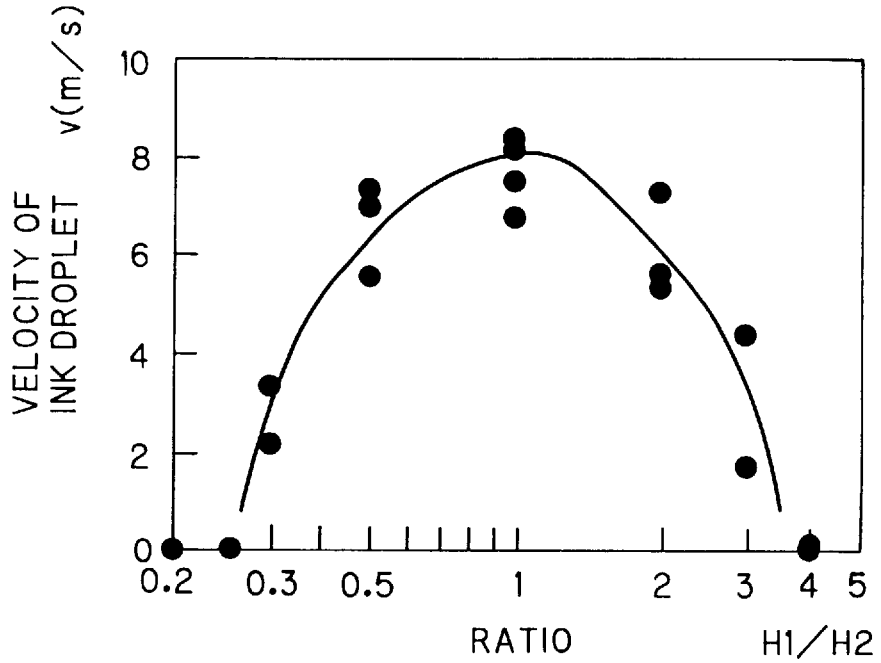
FIG. 12 is a graph illustrating the relationship between the ink droplet velocity v and a H1/12 ratio.

FIG. 12 shows the results of the velocity measurements. It is apparent that the velocity v of the ink droplets was largest and had about the value of 8 m/s when the H1/H2 ratio was approximately 1. When the H1/H2 ratio was in a range between ½ and 2, the velocity v was at least 75% of the maximum value. When the H1/H2 ratio was in a range between ⅓ and 3, the velocity v was at least 50% of the maximum value. When the H1/H2 ratio was out of the range of ⅓ and 3, the velocity v decreased rapidly.

The volume L of the ink droplet changed nearly proportional to the velocity v. That is, the volume reached a maximum value of 80 pl at the H1/H2 ratio of approximately 1. When the H1/H2 ratio was in the range of ½ and 2, the volume L was 75% of the maximum value or more. When the H1/H2 ratio was in the range of ⅓ and 3, the volume L was 50% of the maximum value or more. When the H1/H2 ratio was out of the range of ⅓ and 3, the volume L decreased rapidly.

Similarly to the first experiment, the maximum values of the velocity v and the volume L provided the optimum image quality. When those values reached 75% of the maximum values, the image quality started lowering. However, until the values reached 50% of the maximum values, the image quality was still acceptable. When the values reached 50% of the maximum values, the image quality became unacceptable.

It is noted that FIG. 12 shows the results when the driving voltage was 24 volts. Setting the driving voltage at another value changed the value of the velocity v. However, when the H1/H2 ratio was varied, the location of the maximum value for the velocity v and the graph shape became identical to FIG. 12. Further, the volume L of the ink droplets at other voltage values also showed the same tendency as 24 volts. The obtained image quality also presented the same tendency as 24 volts.

FIG. 12 shows the results when the widths B1 and B2 of the side walls 111 and 116 were fixed to 70 μm and the width W of the ink chamber 112 was fixed to 70 μm. However, even when the widths B1 and B2 were varied in a range from 40 μm to 100 μm and the width W was varied in a range from 40 μm to 100 μm, as the H1/H2 ratio varied, the location of the maximum value for the velocity v and the graph shape became identical to FIG. 12. Further, the volume L of the ink droplets also showed the same tendency as the widths B1 and B2 of 70 μm and as the width W of 70 μm. The obtained image quality also presented the same tendency as the widths B1 and B2 of 70 μm and as the width W of 70 μm.

The above results show that the ink jet print head 301 of the present embodiment can be configured so that the H1 and H2 are different from each other so long as the H1/H2 ratio does not exceed the upper limit of 3 or the lower limit of ⅓. More preferably, the H1/H2 ratio should not exceed the upper limit of 2 and the lower limit of ½. This is because if the H1/H2 ratio exceeds these upper or lower limits, then the velocity and volume of the ink droplets will become insufficient to form characters and images on the paper surface which is located opposite the ink jet print head. Therefore, the driving circuit has to be increased in complexity and size in order to produce a higher driving voltage. By contrast, according to the present embodiment, the H1/H2 ratio does not exceed the upper or lower limits, it is possible to eject ink droplets with sufficient velocity and volume to form characters and images even at a low driving voltage. More specifically, as apparent from the examination results, an ink droplet velocity of 3 to 8 m/s and volume of 30 to 80 pl can be obtained at a low driving voltage of 18 to 28 volts. This allows simplification and miniaturization of the driving circuit, enabling the achieving of a lower cost and smaller size for the whole ink jet print head.

Additionally, it is unnecessary to produce the actuator plates 102 and 103 so that the heights H1 and H2 are completely equal to each other so long as the difference between the heights H1 and H2 does not cause the H1,H2 ratio to exceed the upper limit of 3 or the lower limit of ⅓. Accordingly, the side walls 111 and 116 can be easily produced through the grinding operation.

[Third Experiment]

Figure 13:
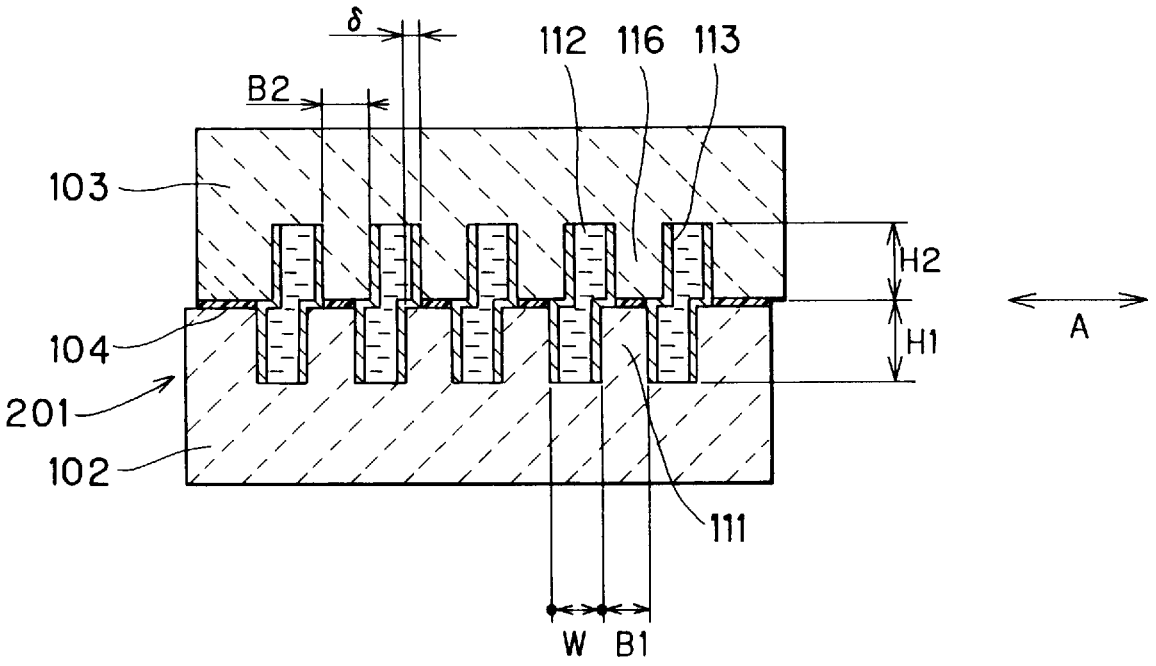
FIG. 13 illustrates a cross-section of an example of print head samples, used in a third experiment, where side walls of a first actuator plate are shifted from side walls of a second actuator plate with a shift amount δ.

The present inventor produced several print heads 301 shown in FIG. 13 where the actuator plates 102 and 103 were bonded with each other with the side walls 111 and 116 being shifted from each other in the direction A with various values of the shift amount δ. In those print head samples 301, the ink channels 112 (i.e., the grooves 115 and 117) had various values of widths W (=W1, W2). That is, the present inventor produced several print head samples 301 with different δ/W ratios. Those print head samples were produced in the same manner as in the first experiment.

In the thus prepared several samples, the heights H1 and H2 of the side walls 111 and 116 were fixed to 200 μm. The width W (=W1, W2) of the ink chamber 112 was varied over a range of 40 μm to 100 μm. The widths B1 and B2 of the side walls 111 and 116 were fixed to 70 μm.

The present inventor then examined the printing performances obtained by those print head samples 301. More specifically, in each of the thus prepared sample leads, a fixed driving voltage (24 volts) was applied to the electrodes 113 and 114 for one ink chamber 112 so that an ink droplet be ejected from the corresponding nozzle. Then, the velocity and volume of the ink droplet were measured in the same manner as in the first experiment.

Figure 14:
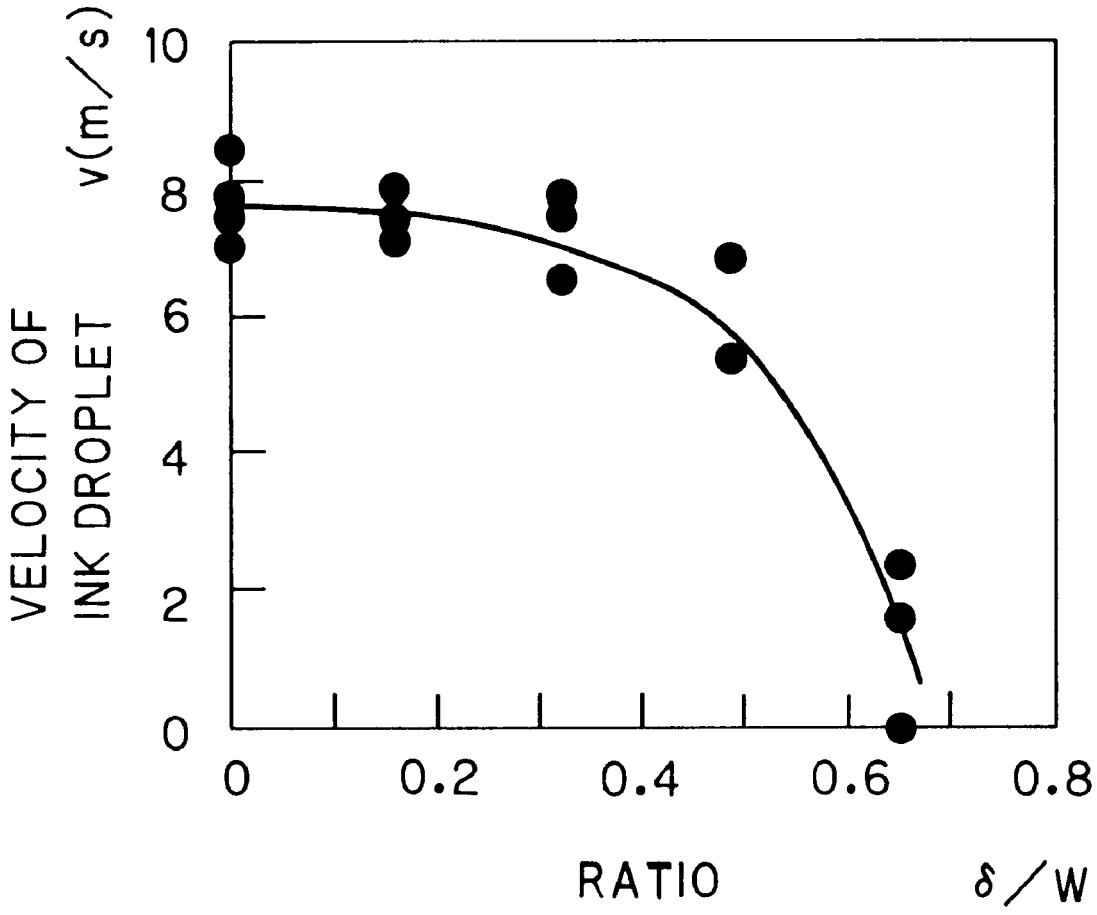
FIG. 14 is a graph illustrating the relationship between the ink droplet velocity v and a δ/W ratio where W is a width of an ink chamber.

FIG. 14 shows the results of the velocity measurements. It is apparent that the velocity v of the ink droplets was largest and had about the value of 8 m/s when the δ/W ratio was approximately 0. As δ/W ratio increased, the velocity v decreased. More specifically, as the δ/W ratio increased up to an upper limit of 0.3, the velocity v changed little. As the δ/W ratio further increased up to another upper limit of 0.5, the velocity v decreased to 75% of the maximum value. When the δ/W ratio exceeded the upper limit of 0.5, the velocity v decreased rapidly.

The volume L of the ink droplet changed nearly proportional to the velocity v, reaching a maximum value of 80 pl at a δ/W ratio of approximately 0. As δ/W ratio increased, the volume decreased. More specifically, for a δ/W lower than or equal to 0.3, the volume changed little. For a δ/W lower than or equal to 0.5, the volume was at least 75% of the maximum value. When the δ/W ratio exceeded 0.5, the volume decreased rapidly.

Similarly to the first experiment, the maximum values of the velocity v and the volume L provided the optimum image quality. While those values changed little, the optimum image quality was obtained. When those values reached 75% of the maximum values, the image quality started lowering. However, the image quality was still acceptable.

It is noted that FIG. 14 shows the results when the driving voltage was 24 volts. However, although setting the driving voltage at another value changed the value of the velocity v, when the δ/W ratio was varied, the location of the maximum value for the velocity v and the graph shape became identical to FIG. 14. Further, the volume L of the ink droplets at other voltage values also showed the same tendency as 24 volts. The obtained image quality also presented the same tendency as 24 volts.

Similarly, FIG. 14 shows the results when the widths B1 and B2 of the side walls 111 and 116 were fixed to 70 μm. However, for the widths B1 and B2 in a range from 40 μm to 100 μm, when the δ/W ratio was varied, the location of the maximum value for the velocity v and the graph shape became identical to FIG. 14. Further, the volume L of the ink droplets also showed the same tendency as the widths B1 and B2 of 70 μm. The obtained image quality also presented the same tendency as the widths B1 and B2 of 70 μm.

It is additionally noted that FIG. 14 shows the results when the heights H1 and H2 of the side walls 111 and 116 were fixed to 200 μm. However, for the heights H1 and H2 in a range from 100 μm to 400 μm, when the δ/W ratio was varied, the location of the maximum value for the velocity v and the graph shape became identical to FIG. 14. Further, the volume L of the ink droplets also showed the same tendency as the heights H1 and H2 of 200 μm. The obtained image quality also presented the same tendency as the heights H1 and H2 of 200 μm.

The above results show that the ink jet print head 301 of the present embodiment can be configured so that the upper and lower actuator plates 102 and 103 are shifted from each other so long as the δ/W ratio does not exceed the limit of 0.5. More preferably, the δ/W ratio should not exceed the limit of 0.3. This is because if the δ/W ratio exceeds the limit, then the velocity and volume of the ink droplets wall become insufficient to form characters and images on the paper surface which is located opposite the ink jet print head. Therefore, the driving circuit has to be increased in complexity and size in order to produce a higher driving voltage. By contrast, according to the present embodiment, the δ/W ratio does not exceed the limit, it is possible to eject ink droplets with sufficient velocity and volume to form characters and images even at a low driving voltage. More specifically, as apparent from the examination results, an ink droplet velocity of 3 to 8 m/s and volume of 30 to 80 pl can be obtained at a low driving voltage of 18 to 28 volts. This allows simplification and miniaturization of the driving circuit, enabling the achieving of a lower cost and smaller size for the whole ink jet print head.

Additionally, it is unnecessary to bond the actuator plates 102 and 103 so that the shift amounts δ are completely zero so long as the shift amount δ does not cause the δ/W ratio to exceed the upper limit of 0.5. Accordingly, the side walls 111 and 116 can be easily produced through the grinding operation.

[Fourth Experiment]

Figure 15:
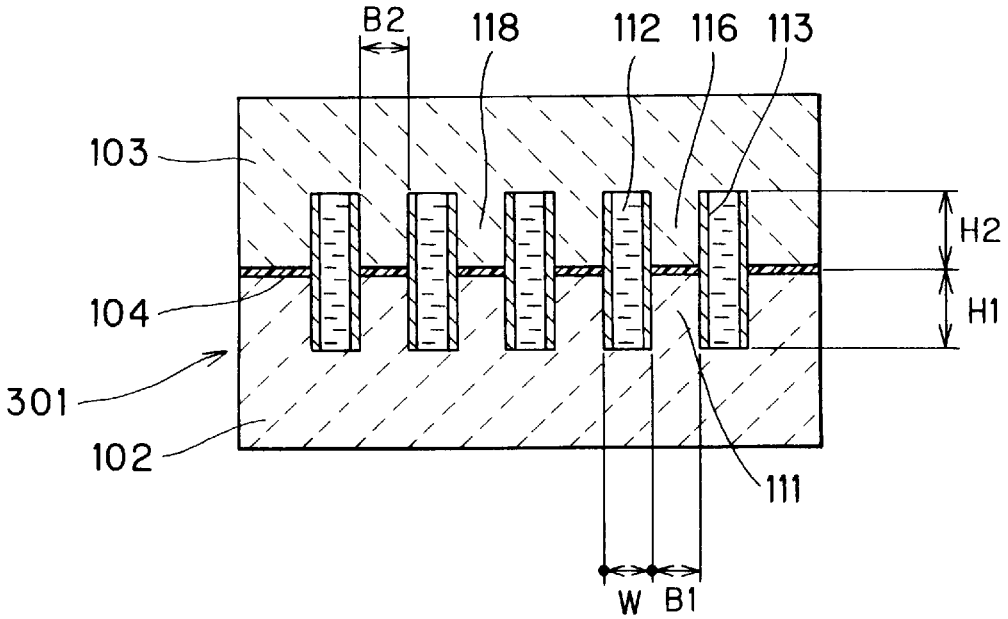
FIG. 15 illustrates a cross-section of an example of print head samples, used in a fourth experiment, where a first actuator plate hat a side wall width B1 and a second actuator plate has a side wall width B2 and the first and second actuator plates have an ink chamber width W.

The present inventor produced several print heads 301 shown in FIG. 15 where the widths B1 and B2 of the side walls 111 and 116 and the width W of the ink chambers 112 had various values, and examined the printing performances obtained by those print heads 301. That is, the present inventor produced several print head samples 301 with different W/B ratios where W=W1, W2 and B=B1, B2. Those print head samples were produced in the same manner as in the first experiment.

In the thus prepared several samples, the widths B1 and B2 (B) of the side walls 111 and 116 were substantially equal to each other and varied over a range of 40 μm to 200 μm. The widths W1 and W2 (W of the ink chambers 112) of the grooves 115 and 117 were substantially equal to each other and varied over a range of 40 μm to 200 μm. The heights H1 and H2 of the side walls 111 and 116 were fixed to 200 μm.

In each of the thus prepared sample heads, a fixed driving voltage (24 volts) was applied to the electrodes 113 and 114 for one ink chamber 112 so that an ink droplet be ejected from the corresponding nozzle. Then, the velocity and volume of the ink droplet were measured in the same manner as in the first experiment.

Figure 16:
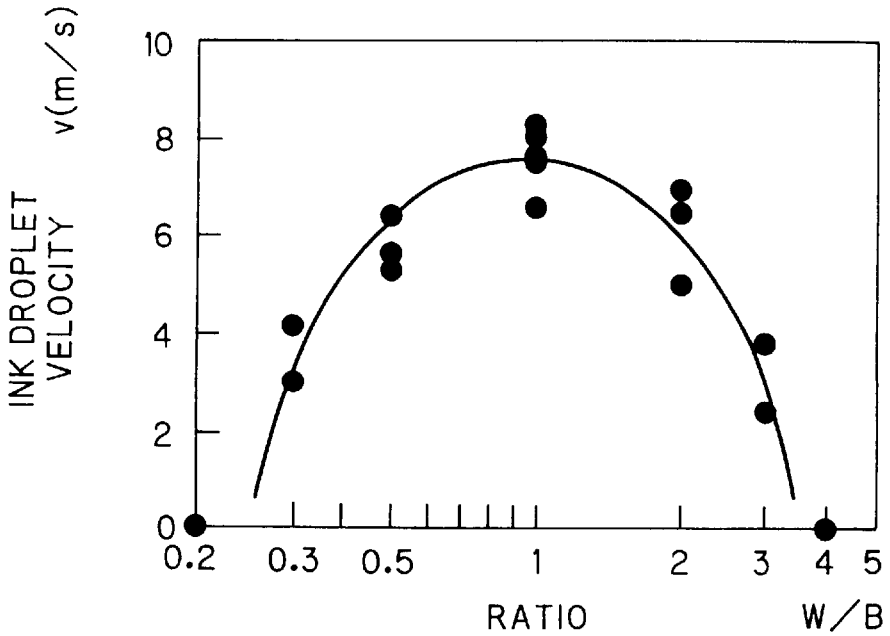
FIG. 16 is a graph illustrating the relationship between the ink droplet velocity v and a W/B ratio where B=B1, B2.

FIG. 16 shows the results of the velocity measurement. As apparent from FIG. 16, the velocity v of the ink droplets was largest when the W/B ratio was approximately 1. When the W/B ratio was in the range of ½ and 2, the velocity v was at least 75% of the maximum value. When the W/B ratio was in the range of ⅓ and 3, the velocity v was at least 50% of the maximum value. When the W/B ratio was out of the range of ⅓ and 3, the velocity v decreased rapidly. The volume L of the ink droplet changed nearly proportional to the velocity v, reaching a maximum value of 80 pl at the W/B ratio of approximately 1. When the W/B ratio was in the range of ½ and 2, the volume L was at least 75% of the maximum value. When the W/B ratio was in the range of ⅓ and 3, the volume L was at least 50% of the maximum value. When the W/B ratio was out of the range of ⅓ and 3, the volume L decreased rapidly.

Similarly to the first experiment, the maximum values of the velocity v and the volume L provided the optimum image quality. When those values reached 75% of the maximum values, the image quality started lowering. However, until the values reached 50% of the maximum values, the image quality was still acceptable. When the values reached 50% of the maximum values, the image quality became unacceptable.

It is noted that FIG. 16 shows the results when the driving voltage was 24 volts. However, although setting the driving voltage at another value changed the value of the velocity v, when the W/B ratio was varied, the location of the maximum value for the velocity v and the graph shape became identical to FIG. 16. Further, the volume L of the ink droplets at other voltage values also showed the same tendency as 24 volts. The obtained image quality also presented the same tendency as 24 volts.

In addition, FIG. 16 shows the results when the heights H1 and H2 of the side walls 111 and 116 were fixed to 200 μm. However, for the heights H1 and H2 in a range from 100 μm to 400 μm, when the W/B ratio was varied, the location of the maximum value for the velocity v and the graph shape became identical to FIG. 16. Further, the volume L of the ink droplets also showed the same tendency as the heights H1 and H2 of 200 82 m. The obtained image quality also presented the same tendency as the heights H1 and H2 of 200 μm.

The above results show that the ink jet print head 301 of the present embodiment can be configured with the W/B ratio preferably being in a range of ⅓ and 3, and more preferably, in a range of ½ and 2. This is because if the W/B ratio is out of the range described above, then the velocity and volume of the ink droplets will become insufficient to form characters and images on the paper surface which is located opposite the ink jet print head. Therefore, the driving circuit has to be increased in complexity and size in order to produce a higher driving voltage. By contrast, according to the present embodiment, the W/B ratio being in the above-described range, it is possible to eject ink droplets with sufficient velocity and volume to form characters and images even at a low driving voltage. More specifically, as apparent from the examination results, an ink droplet velocity of 3 to 8 m/s and volume of 30 to 80 pl can be obtained at a low driving voltage of 18 to 28 volts. This allows simplification and miniaturization of the driving circuit, enabling the achieving of a lower cost and smaller size for the whole ink jet print head.

As described above, in accordance with the ink jet print head of the present invention, the B1/B2 ratio is greater than or equal to ½ and less than or equal to 2, the H1/H2 ratio is greater than or equal to ⅓ and less than or equal to 3, the δ/W ratio is equal to or lower than 0.5, and the W/B ratio is equal to or greater than ⅓ and lower than or equal to 3. It therefore becomes possible to eject an ink droplet with sufficient velocity and volume to form characters and images even with a low driving voltage. As a result, this allows simplification and miniaturization of the driving circuit, enabling the achieving of a lower cost and smaller size for the print head.

While the invention has been described in detail with reference to specific embodiment thereof, it would be apparent to those skilled in the art that various changes and modifications may be made therein without departing from the spirit of the invention.

For example, in the above-described embodiment, the top surface portion of the side wall 111 in the actuator plate 102 is bonded with the top surface portion of the side wall 116 in the actuator plate 103, forming ink chambers 112 in the ink jet print head 301.

However, the ink jet print head can be produced from a flat plate-shaped first piezoelectric ceramic plate bonded to a flat plate-shaped second piezoelectric ceramic plate with the second piezoelectric ceramic plate on top. Afterward, grooves are formed beginning from the second piezoelectric ceramic plate with a depth reaching to the first piezoelectric ceramic plate. Ink chambers are then formed in the ink jet print head by covering the grooves with a cover plate.

Figure 17A:
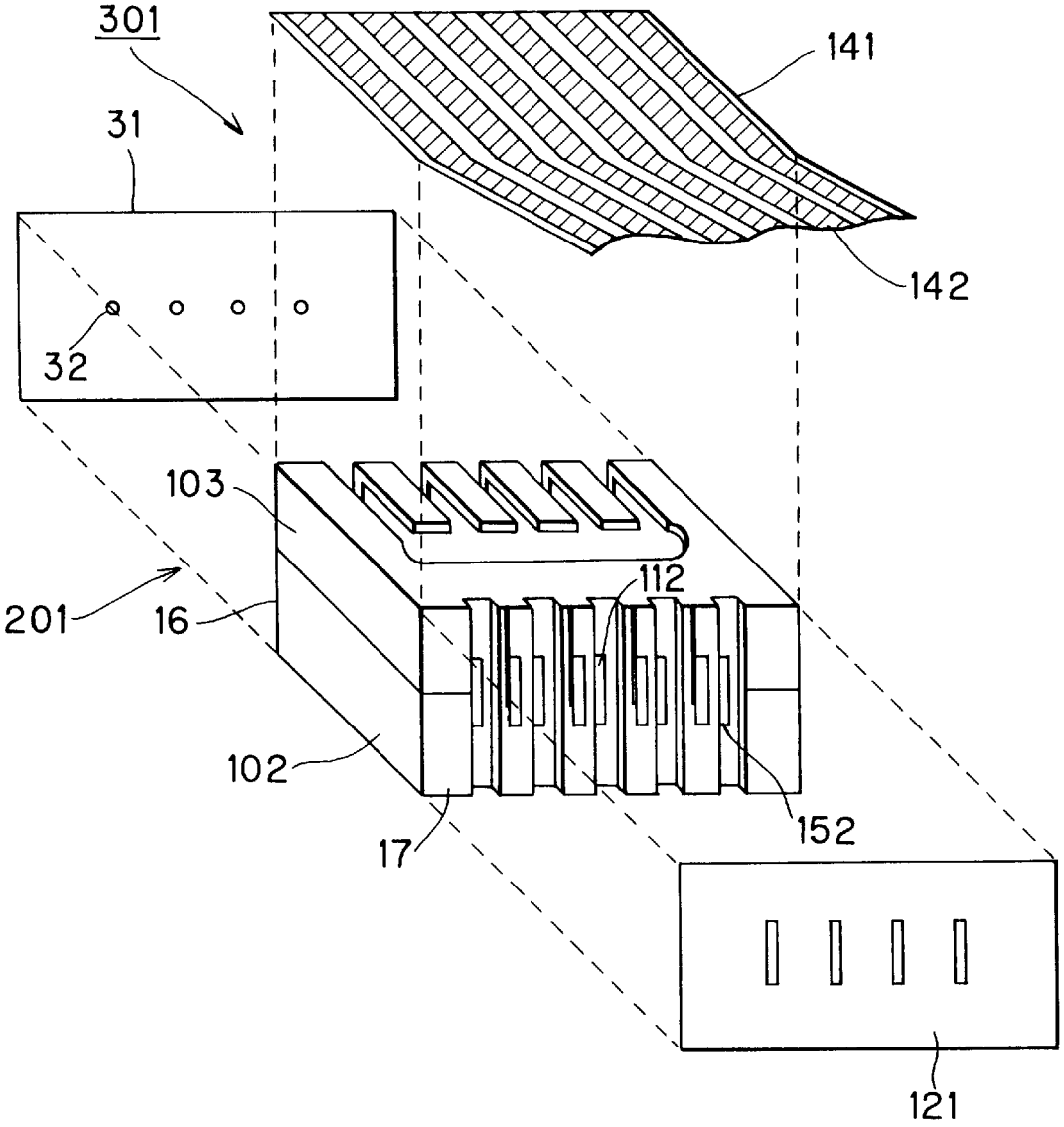
FIG. 17 (A) is a perspective view illustrating how the ink jet print head of a modification of the present invention is assembled.
FIG. 17(B) is a perspective view showing a front surface of the actuator portion of the ink jet print head of FIG. 17(A).
Figure 17B:
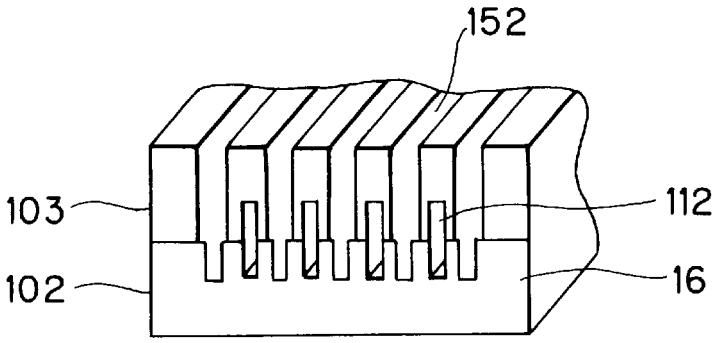

Further, in the above-described embodiment, the ink chambers 112 are adjacent to each other. However, air chambers filled with air may be provided between each ink chamber. In this case, ink droplets can be ejected at the same time from two nozzles connected to all of the ink chambers. FIGS. 17(A) and 17(B) show how to configure the ink jet print head where ink chambers 112 and air chambers 152 are arranged alternately with each other. As apparent from FIGS. 17(A) and 17(B), the air chambers 152 are opened also at the upper surface of the actuator portion 201 at the front end surface 16. The electrodes 113 and 114 formed on the inner side surfaces of the air chambers 152 are connected to the conductor patterns 142 via those opened sections.

It is noted that even if the air chambers are thus provided, when the various ratios are varied, the locations of the maximum values of the velocity v and volume L of the ink droplet and the graph shape are identical to the cases without air chambers. As a result, the above-described effect can be obtained if the ink jet print head is configured with the above-described size relationships.

In the above-described embodiment, the side walls 111 and 116 are each formed from a single piezoelectric material member (actuator plates 102 and 103). However, each side wall may be formed from a plurality of piezoelectric material members stacked along the polarization direction. Or, the side wall may be formed from members made of nonpiezoelectric material and piezoelectric material stacked alternately along the polarization direction. Still further, the ink jet print head of the present invention may have any number of ink chambers, such as 50, 100, or any number of ink chambers.

I claim:

1. An ink jet print head for ejecting ink droplets, the ink jet print head comprising:

a first actuator plate formed with a plurality of first side walls and a plurality of first grooves, each of said first grooves being defined between corresponding two adjacent ones of said first side walls, the first side walls including piezoelectric material polarized in a first direction, the first side walls being elongated in the first direction defining a first height, a first electrode being formed on each of said first side walls; and a second actuator plate formed with a plurality of second side walls and a plurality of second grooves, each of said second grooves being defined between corresponding two adjacent ones of said second side walls, the second side walls including piezoelectric material polarized in a second direction opposite to the first direction, the second side walls being elongated in the second direction defining a second height, a second electrode being formed on each of said second side walls, the second height being different from the first height, a ratio of the first height to the second height not exceeding an upper limit of 3:1 and not less than a lower limit of 1:3, the second actuator plate being connected to the first actuator plate so that one end of each of said first side walls is connected to one end of a corresponding one of said second side walls, each said first groove communicating with a corresponding one of said second grooves to form an ink chamber.

2. An ink jet print head of claim 1, wherein the ratio of the first height to the second height does not exceed an upper limit of 2:1 and is not less than a lower limit of 1:2.

3. An ink jet print head of claim 1, wherein one of the first side walls has a first width, and the corresponding one of the second side walls has a second width, the second width being different from the first width, a ratio of the first width to the second width not exceeding an upper limit of 2:1 and not less than a lower limit of 1:2.

4. An ink jet print head of claim 3, wherein the ratio of the first width to the second width does not exceed an upper limit of 3:2 and is not less than a lower limit of 2:3.

5. An ink jet print head of claim 1, wherein each said first side wall is connected to the corresponding said second side wall so that the first side wall is offset from the second side wall in a direction normal to the first direction and normal to the second direction by an offset amount, a ratio of the offset amount to a width of the ink chamber is greater than 0 and less than or equal to 1:2.

6. An ink jet print head of claim 5, wherein the ratio of the offset amount to the width of the ink chamber greater than 0 and less than or equal to 3:10.

7. An ink jet print head of claim 1, wherein a ratio of a width of the ink chamber to a width of one of one said first side wall and the corresponding said second side wall is in a range from 1:3 to 2:1.

8. An ink jet print head of claim 7, wherein the ratio of the width of the ink chamber to the width of one of the one said first side wall and the corresponding said second side wall is in a range from 1:2 to 2:1.

9. An ink jet print head of claim 1, further comprising a nozzle plate having a plurality of nozzles communicated with the ink chambers.

10. An ink jet print head of claim 1, further comprising an ink introduction port for supplying ink to the ink chambers.

11. An ink jet print head of claim 1, further comprising a control portion, electrically connected to the first electrodes on the first side walls and the second electrodes on the second side walls, for selectively supplying electric voltages so as to develop electric fields through the first side walls and the second side walls, thereby allowing the first side walls and the second side walls to be deformed and to apply pressure in ink filled in the ink chamber.

12. An ink jet print head of claim 1, wherein the first electrode is formed on a first side surface of each of said first side walls and extends in the first direction and the second electrode is formed on a second side surface of each of said second side walls and extends in the second direction.

13. An ink jet print head, for ejecting ink droplets, comprising:

a first actuator plate formed with a plurality of first side walls arranged in a predetermined direction and a plurality of first grooves, the first side walls including a piezoelectric material polarized in a first direction normal to the predetermined direction, the first side walls being elongated in the first direction, each of said first grooves being formed between a corresponding set of two adjacent ones of said first side walls, a first electrode being provided on each of said first side walls, each of said first side walls having a first width; and a second actuator plate formed with a plurality of second side walls arranged in the predetermined direction and a plurality of second grooves, the second side walls including a piezoelectric material polarized in a second direction normal to the predetermined direction and opposite to the first direction, the second side walls being elongated in the second direction, each of said second grooves being formed between a corresponding set of two adjacent ones of said second side walls, a second electrode being provided on each of said second side walls, each of the second side walls having a second width, the second actuator plate being connected to the first actuator plate so that one end of each of said first side walls is connected to one end of a corresponding one of said second side walls, each said first groove communicating with a corresponding one of said second grooves to form an ink chamber, the first width of the first side walls differing from the second width of the second side walls and a ratio of the first width to the second width being in a range from 1:2 to 2:1.

14. An ink jet print head of claim 13, wherein the ratio of the first width to the second width is in a range from 2:3 to 3:2.

15. An ink jet print head of claim 13, wherein one of the first side walls has a first length along the first direction, and the corresponding one of said second side walls has a second length along the second direction, the first length being substantially equal to the second length.

16. An ink jet print head of claim 13, wherein one of the first side walls has a first length along the first direction, and the corresponding one of said second side walls has a second length along the second direction, a ratio of the first length to the second length being in a range from 1:3 to 3:1.

17. An ink jet print head of claim 16, wherein the ratio of the first length to the second length is in a range from 1:2 to 2:1.

18. An ink jet print head of claim 13, wherein the one ends of the first side walls are offset by an offset amount from the one ends of the second side walls in the predetermined direction, a ratio of the offset amount to a width of the ink chamber is greater than 0 and less than or equal to 1:2.

19. An ink jet print head of claim 18, wherein the ratio of the offset amount to the width of the ink chamber is greater than 0 and less than or equal to 3.10.

20. An ink jet print head of claim 13, wherein a ratio of a width of the ink chambers to one of the first width and the second width is in a range from 1:3 to 3.1.

21. An ink jet print head of claim 20, wherein the ratio of the width of the ink chambers to one of the first width and the second width is in a range from 1:2 to 2.

22. An ink jet print head of claim 13, further comprising a control portion, electrically connected to the first electrodes on the first side walls and the second electrodes on the second side walls, for selectively supplying electric voltages so as to develop electric fields through the first side walls and the second side walls, thereby allowing the first side walls and the second side walls to be deformed and to apply pressure in ink filled in the ink chamber.

23. An ink jet print head of claim 13, wherein the first electrode is formed on a first side surface of each of said first side walls and extends in the first direction and the second electrode is formed on a second side surface of each of said second side walls and extends in the second direction.

24. An ink jet print head, for ejecting ink droplets, comprising:

a first actuator plate formed with a plurality of first side walls arranged in a predetermined direction and a plurality of first grooves, the first side walls including a piezoelectric material polarized in a first direction normal to the predetermined direction, the first side walls being elongated in the first direction, each of said first grooves being formed between a corresponding set of two adjacent ones of said first side walls, a first electrode being provided on each of said first side walls, each of said first side walls having a first length along the first direction; and a second actuator plate formed with a plurality of second side walls arranged in the predetermined direction and a plurality of second grooves, the second side walls including a piezoelectric material polarized in a second direction normal to the predetermined direction and opposite to the first direction, the second side walls being elongated in the second direction, each of said second grooves being formed between a corresponding set of two adjacent ones of said second side walls, a second electrode being provided on each of said second side walls, each of the second side walls having a second length along the second direction, the second actuator plate being connected to the first actuator plate so that one end of each of said first side walls is connected to one end of a corresponding one of said second side walls, each said first groove communicating with a corresponding one of said second grooves to form an ink chamber, the first length of the first side walls differing from the second length of the second side walls and a ratio of the first length to the second length being in a range from 1:3 to 3:1.

25. An ink jet print head of claim 24, wherein the ratio of the first length to the second length is in a range from 1:2 to 2:1.

26. An ink jet print head of claim 24, wherein one of the first side walls has a first width in the predetermined direction and the corresponding one of said second side walls has a second width in the predetermined direction, the first width being substantially equal to the second width.

27. An ink jet print head of claim 24, wherein the one end of each of said first side walls is offset an offset amount from the one end of the corresponding one of said second side walls in the predetermined direction, a ratio of the offset amount to a width of the ink chamber is greater than 0 and less than or equal to 1:2.

28. An ink jet print head of claim 27, wherein the ratio of the offset amount to the width of the ink chamber is greater than 0 and less than or equal to 3:10.

29. An ink jet print head of claim 24, wherein one of the first side walls has a first width in the predetermined direction and the corresponding one of said second side walls has a second width in the predetermined direction, a ratio of a width of the ink chamber in the predetermined direction to one of the first width and the second width being in a range from 1:3 to 3:1.

30. An ink jet print head of claim 29, wherein the ratio of the width of the ink chamber to one of the first width and the second width is in a range from 1:2 to 2:1.

31. An ink jet print head of claim 24, further comprising a control portion, electrically connected to the first electrodes on the first side walls and the second electrodes on the second side walls, for selectively supplying electric voltages so as to develop electric fields through the first side walls and the second side walls, thereby allowing the first side walls and the second side walls to be deformed and to apply pressure in ink filled in the ink chamber.

32. An ink jet print head of claim 24, wherein the first electrode is formed on a first side surface of each of said first side walls and extends in the first direction and the second electrode is formed on a second side surface of each of said second side walls and extends in the second direction.

33. An ink jet print head, for ejecting ink droplets, comprising:

a first actuator plate formed with a plurality of first side walls arranged in a predetermined direction and a plurality of first grooves, the first side walls including a piezoelectric material polarized in a first direction normal to the predetermined direction, the first side walls being elongated in the first direction, each of said first grooves being formed between a corresponding set of two adjacent ones of said first side walls, a first electrode being provided on each of said first side walls; and a second actuator plate formed with a plurality of second side walls arranged in the predetermined direction and a plurality of second grooves, the second side walls including a piezoelectric material polarized in a second direction normal to the predetermined direction and opposite to the first direction, the second side walls being elongated in the second direction, each of said second grooves being formed between a corresponding set of two adjacent ones of said second side walls, a second electrode being provided on each of said second side walls, the second actuator plate being connected to the first actuator plate so that one end of each of said first side walls is connected to one end of a corresponding one of said second side walls, each said first groove communicating with a corresponding one of said second grooves to form an ink chamber, the ink chamber having a width in the predetermined direction, the one ends of the first side walls being offset by an offset amount from the one ends of the second side walls in the predetermined direction, a ratio of the offset amount to the width of the ink chamber is greater than 0 and less than or equal to 1:2.

34. An ink jet print head of claim 33, wherein the ratio of the offset amount to the width of the ink chamber is greater than 0 and less than or equal to 3:10

35. An ink jet print head of claim 33, wherein one of the first side walls has a first width in the predetermined direction and the corresponding one of said second side walls has a second width in the predetermined direction, the first width being substantially equal to the second width.

36. An ink jet print head of claim 33, wherein one of the first side walls has a first length along the first direction and the corresponding one of said second side walls has a second length along the second direction, the first length being substantially equal to the second length.

37. An ink jet print head of claim 33, wherein one of the first side walls has a first width and the corresponding one of said second side walls has a second width, a ratio of the width of the ink chamber to one of the first width and the second width being in a range from 1:3 to 3:1.

38. An ink jet print head of claim 37, wherein the ratio of the width of the ink chamber to one of the first width and the second width is in a range from 1:2 to 2:1.

39. An ink jet print head of claim 33, further comprising a control portion, electrically connected to the first electrodes on the first side walls and the second electrodes on the second side walls, for selectively supplying electric voltages so as to develop electric fields through the first side walls and the second side walls, thereby allowing the first side walls and the second side walls to be deformed and to apply pressure in ink filled in the ink chamber.

40. An ink jet print head of claim 33, wherein the first electrode is formed on a first side surface of each of said first side walls and extends in the first direction and the second electrode is formed on a second side surface of each of said second side walls and extends in the second direction.

41. An ink jet print head, for ejecting ink droplets, comprising:

a first actuator plate formed with a plurality of first side walls arranged in a predetermined direction and a plurality of first grooves, the first side walls including a piezoelectric material polarized in a first direction normal to the predetermined direction, the first side walls being elongated in the first direction, each of said first grooves being formed between a corresponding set of two adjacent ones of said first side walls, a first electrode being provided on each of said first side walls, each of said first side walls having a first width in the predetermined direction; and a second actuator plate formed with a plurality of second side walls arranged in the predetermined direction and a plurality of second grooves, the second side walls including a piezoelectric material polarized in a second direction normal to the predetermined direction and opposite to the first direction, the second side walls being elongated in the second direction, each of said second grooves being formed between a corresponding set of two adjacent ones of said second side walls, a second electrode being provided on each of said second side walls, each of the second side walls having a second width in the predetermined direction, the second actuator plate being connected to the first actuator plate so that one end of each of said first side walls is connected to one end of a corresponding one of said second side walls, each said first groove communicating with a corresponding one of said second grooves to form an ink chamber, the ink chamber having a width in the predetermined direction, the first width of the first side walls, the second width of the second side walls, and the width of the ink chamber being so that a ratio of the width of the ink chamber to one of the first width and the second width is in a range from 1:3 to 3:1.

42. An ink jet print head of claim 41, wherein the ratio of the width of the ink chamber to one of the first width and the second width is in a range from 1:2 to 2:1.

43. An ink jet print head of claim 41, wherein the first width is substantially equal to the second width.

44. An ink jet print head of claim 41, wherein one of the first side walls has a first length in the first direction and the corresponding one of said second side walls has a second length in the second direction, the first length being substantially equal to the second length.

45. An ink jet print head of claim 44, further comprising a control portion, electrically connected to the first electrodes on the first side walls and the second electrodes on the second side walls, for selectively supplying electric voltages so as to develop electric fields through the first side walls and the second side walls, thereby allowing the first side walls and the second side walls to be deformed and to apply pressure in ink filled in the ink chamber.

46. An ink jet print head of claim 41, wherein the first electrode is formed on a first side surface of each of said first side walls and extends in the first direction and the second electrode is formed on a second side surface of each of said second side walls and extends in the second direction.

* * * * *